US008250894B2

(12) United States Patent
Yoshioka

(10) Patent No.: US 8,250,894 B2
(45) Date of Patent: Aug. 28, 2012

(54) RELEASING MECHANISM AND LEVELING APPARATUS

(75) Inventor: Takashi Yoshioka, Sagamihara (JP)

(73) Assignee: Aida Engineering, Ltd., Kanagawa (JP)

( * ) Notice: Subject to any disclaimer, the term of this patent is extended or adjusted under 35 U.S.C. 154(b) by 623 days.

(21) Appl. No.: 11/923,848

(22) Filed: Oct. 25, 2007

(65) Prior Publication Data

US 2008/0098786 A1 May 1, 2008

(30) Foreign Application Priority Data

Oct. 30, 2006 (JP) ..... 2006-293421
Oct. 30, 2006 (JP) ..... 2006-293422
Jun. 26, 2007 (JP) ..... 2007-167606

(51) Int. Cl.
*B21D 1/02* (2006.01)
*B21D 3/02* (2006.01)

(52) U.S. Cl. ..... 72/164; 72/165; 72/160

(58) Field of Classification Search ..... 72/164, 72/165, 163, 205, 160
See application file for complete search history.

(56) References Cited

U.S. PATENT DOCUMENTS 4,881,392 A * 11/1989 Thompson et al. ..... 72/164
6,651,476 B2 * 11/2003 Nordlof ..... 72/164
6,769,279 B1 * 8/2004 Bergman et al. ..... 72/165
7,383,711 B2 * 6/2008 McKenna ..... 72/164
2006/0225475 A1 * 10/2006 Matsumoto et al. ..... 72/20.1
2006/0277959 A1 * 12/2006 McKenna ..... 72/160

FOREIGN PATENT DOCUMENTS

CN 1843647 A 10/2006
JP 3-90214 A 4/1991
JP 5-70719 U 9/1993
JP 5-88706 U 12/1993
JP 8-117854 A 5/1996
JP 10-94830 A 4/1998
JP 2004-216427 A 8/2004

OTHER PUBLICATIONS

Machine Translation of Japanese Utility Model application Laid-Open No. H05-88706.*

* cited by examiner

*Primary Examiner* — Edward Tolan
*Assistant Examiner* — Mohammad I Yusuf
(74) *Attorney, Agent, or Firm* — McDermott Will & Emery LLP

(57) ABSTRACT

A release mechanism for use in a leveling apparatus that performs a leveling process on a work object that has been wound in a coil configuration as a result of the work object being passed between a front side work roll in contact with the front side surface of the work object and a back side work roll that is in contact with the back side surface of the work, wherein the releasing mechanism switches between a work clamp state that allows performance of the leveling process and a release state that releases the work object from the clamp state by displacing a work roll support member that supports one of the work rolls relative to the another support member to change a distance between the work rolls by utilizing rotational movement of an electric motor.

10 Claims, 11 Drawing Sheets

RELEASING MECHANISM AND LEVELING APPARATUS

FIELD OF THE INVENTION

The present invention relates to a work release mechanism for use in a leveling apparatus (or straightener) for leveling (or correcting) deformation such as winding strain of a work object and to a leveling apparatus equipped with such a release mechanism.

BACKGROUND

When a press work is performed, for example, on a work object (e.g. a long metal plate) that has been wound in a coil (or roll) configuration, it is necessary to feed the work object to a press work apparatus at a predetermined (or desired) feed speed (or ratio) while leveling it to eliminate winding strain. To this end, various types of so-called straightener feeders have been developed.

When positioning of the work object is to be performed in a press work apparatus, it is required for the straightener feeder to release clamping of the work object to set it free with respect to the plane of the work object or at least with respect to the work feeding direction, in order to attain precise positioning and to prevent deformation of the work object. Similarly, at the time when working that involves deformation of a work object is performed, it is required for the straightener feeder to release the work object from the clamped state.

A straightener portion and a feeder portion of a straightener feeder generally have a roll(s) to be in contact with the front surface of the work object and a roll(s) to be in contact with the back surface of the work object, and the work object is pressed between these rolls. It is required for the straightener feeder to be able to perform an opening operation, that is, an operation in which the roll(s) disposed on the front side of the work object and the roll(s) disposed on the back side of the work object are spaced apart to a relatively large extent at the time when the leading edge of the work object is to be inserted into the straightener portion of the straightener feeder upon threading or when maintenance such as cleaning of the rolls or other portions is to be performed as occasion demands.

Japanese Patent Application Laid-Open No. H10-94830 and Japanese Utility Model Application Laid-Open No. H05-70719, describe a frame that supports rolls disposed on the front side of the work object are adapted to be able to move upwardly utilizing back and forth movement of an actuator such as a cylinder thereby moving the rolls disposed on the front side of the work object away from rolls disposed on the back side to perform the release operation and the opening operation.

According to a technology described in Japanese Utility Model Application Laid-Open No. H05-88706, an eccentric shaft is turned by an electric motor, and a frame that supports rolls disposed on the front side of the work object is adapted to be able to move upwardly utilizing the eccentricity of the eccentric shaft thereby moving the rolls on the front side of the work object away from rolls on the back side to perform the release operation.

In the apparatuses described in Japanese Patent Application Laid-Open No. H10-94830 and Japanese Utility Model Application Laid-Open No. H05-70719 mentioned above, the release operation is performed using a cylinder in synchronization with press work that is performed at a relatively short cycle time, and accordingly a large noise is generated upon switching of an electromagnetic valve and/or upon collision occurring at cylinder ends. Therefore, there is a demand for reducing such noise to improve the working environment.

In the case where a cylinder is used, there is a relatively long delay time since a clamp signal for causing the straightener feeder to terminate the releasing state and clamp the work is generated until the operation pressure actually reaches a predetermined level. For this reason, it is not possible to adapt the release operation in such a way as to satisfactorily meet demands for increases in the number of strokes of press work per unit time (or increases in press work speed).

In the arrangement in which the released state is terminated by rotating an eccentric shaft using an electric motor as disclosed in Japanese Utility Model Application Laid-Open No. H05-88706, the amount of eccentricity in the eccentric shaft is determined in advance in adaptation to the release operation, and if the amount of eccentricity is to be changed, it is needed to replace the eccentric shaft with another shaft having a different amount of eccentricity. Accordingly, it is difficult to open the rolls to a large extent. Therefore, it is necessary to provide a separate mechanism for performing the opening operation to allow to perform, for example, cleaning of the rolls and threading of a work object into the straightener feeder, in addition to the release mechanism operated by rotating the eccentric shaft with the electric motor. This disadvantageously leads to an increase in the size and complexity of the apparatus and causes various problems in terms of cost and ease of installation, assembly and maintenance of the apparatus.

SUMMARY OF THE INVENTION

The present invention has been made in view of the above descried situations and has as an object to provide a release mechanism that can perform, even with a relatively simple structure, release operations with good response and low noise while improving the working environment. Another object of the present invention is to provide a leveling apparatus that can perform an opening operation that satisfactorily allows to perform work threading and maintenance as well as a release operation as described above even with a relatively simple structure.

According to the present invention, there is provided a release mechanism for use in a leveling apparatus that performs a leveling process on a work object that has been wound in a coil configuration by causing the work object to pass between at least one front side work roll that is in contact with the front side surface of the work object and at least one back side work roll that is in contact with the back side surface of the work and has a rotation axis offset with respect to the work feeding direction from a rotation axis of the front side work roll, wherein the releasing mechanism is arranged so as to switch over between a work clamp state that allows to perform said leveling process and a release state that releases the work object from said clamp state by displacing at least one of a front side work roll support member that supports the front side work roll and a back side work roll support member that supports the back side work roll relative to the other utilizing rotational movement of an electric motor in forward and reverse directions thereby changing the distance between the front side work roll and the back side work roll.

According to the present invention there is also provided a release mechanism for use in a leveling apparatus that performs a leveling process on a work object that has been wound in a coil configuration by causing the work object to pass between at least one front side work roll that is in contact with the front side surface of the work object and at least one back side work roll that is in contact with the back side surface of the work object and has a rotation axis offset with respect to the work feeding direction from a rotation axis of said front side work roll. The release mechanism includes: a conversion device that converts rotational movement of an electric motor in forward and reverse directions into back and forth movement of an output member to output it, wherein the releasing mechanism is arranged so as to switch between a work clamp state that allowing performance of a leveling process and a release state that releases the work object from the clamp state by displacing at least one of a front side work roll support member that supports the front side work roll and a back side work roll support member that supports the back side work roll relative to the other utilizing back and forth movement of the output member output by the conversion device thereby changing the distance between the front side work roll and the back side work roll.

The aforementioned electric motor may be a servo motor. The aforementioned conversion device may include a ball screw mechanism.

According to the present invention, there is provided a leveling apparatus that performs a leveling process on a work object by causing the work object to pass between at least one front side work roll that is in contact with the front side surface of the work object and at least one back side work roll that is in contact with the back side surface of the work object and has a rotation axis offset with respect to the work feeding direction from a rotation axis of said front side work roll and comprises the release mechanism according to the present invention.

The aforementioned release mechanism may be adapted to function as an opening mechanism to displace at least one of the front side work roll support member and the back side work roll support member relative to the other utilizing rotational movement of the electric motor in a forward or reverse direction at a time at least when the leveling process is suspended thereby separating the front side work roll and the back side work roll.

The aforementioned releasing mechanism may be adapted to function as a pressing-down mechanism to displace at least one of the front side work roll support member and the back side work roll support member relative to the other utilizing rotational movement of the electric motor in forward and reverse directions thereby enabling adjustment of pressing-down amount of said upper work roll against the work object.

The leveling apparatus according to the present invention may comprise:

a lower taper block on which the front side work roll is supported, the lower taper block having a tapered surface on its top surface;

an upper taper block having a tapered surface on its bottom surface, the tapered surface of the upper taper block being opposed to said tapered surface of the lower taper block;

a shaft-like screw member screwed to the upper taper block; and a pressing-down mechanism that can adjust a pressing down amount of the upper work roll against the work by rotating the screw member by an electric motor to cause the upper taper block to move back and forth along the screw member thereby adjusting the relative position of the tapered surface on the bottom surface of the upper taper block and the tapered surface on the top surface of the lower taper block opposed to the tapered surface on the bottom surface of the upper taper block.

According to the present invention there is also provided a release mechanism for use in a leveling apparatus that performs a leveling process on a work object that has been wound in a coil configuration by causing the work object to pass between at least one front side work roll that is in contact with the front side surface of the work object and at least one back side work roll that is in contact with the back side surface of the work object and has a rotation axis offset with respect to the work feeding direction from a rotation axis of said front side work roll, comprising:

a first conversion device that converts rotational movement of an electric motor in forward and reverse directions into back and forth movement of an output member to output it;

a second conversion device that converts back and forth movement of the output member output by the first conversion device into rotational movement of a rotary shaft for releasing; and a reciprocating member that is moved back and forth utilizing eccentric action caused by rotational movement of an eccentric mechanism provided on the rotary shaft for releasing, wherein the releasing mechanism is arranged so as to switch over between a work clamp state allowing performance of the leveling process and a release state that releases the work object from said clamp state by displacing a front side work roll support member to which a part of said reciprocating member is connected and that supports said front side work roll relative to a back side work roll support member that supports said back side work roll utilizing back and forth movement of said reciprocating member thereby changing the distance between said front side work roll and said back side work roll.

The aforementioned electric motor may be a servo motor. The aforementioned first conversion device can comprise a ball screw mechanism.

In the release mechanism according to the present invention, the reciprocating member may comprise a reciprocation actuator. In addition, the release mechanism may comprise an opening mechanism that displaces the front side work roll support member relative to the back side work roll support member by extending an output member of the reciprocation actuator at a time at least when the leveling process is suspended thereby separating the front side work roll and the back side work roll.

According to the present invention, there is provided a leveling apparatus that performs a leveling process on a work object by causing the work object to pass between at least one front side work roll that is in contact with the front side surface of the work object and at least one back side work roll that is in contact with the back side surface of the work object and has a rotation axis offset with respect to the work feeding direction from a rotation axis of said front side work roll and comprises the release mechanism according to the present invention.

The leveling apparatus according to the present invention may comprise:

a lower taper block on which the front side work roll is supported, the lower taper block having a tapered surface on its top surface;

an upper taper block having a tapered surface on its bottom surface, the tapered surface of the upper taper block being opposed to the tapered surface of the lower taper block;

a shaft-like screw member screwed to the upper taper block; and a pressing-down mechanism that can adjust a pressing down amount of the upper work roll against the work by rotating the screw member by an electric motor to cause said upper taper block to move back and forth along the screw member thereby adjusting the relative position of the tapered surface on the bottom surface of the upper taper block and the tapered surface on the top surface of the lower taper block opposed to the tapered surface on the bottom surface of the upper taper block.

The release mechanism according to the present invention can perform release operations with good response even with a relatively simple structure, and improve the working environment thanks to a reduction in noise. In addition, by using the release mechanism according to the present invention, a leveling apparatus that can perform an opening operation that satisfactorily allows performance of threading and maintenance as well as a release operation as described above even with a relatively simple structure and perform a press-down operation.

DETAILED DESCRIPTION

In the following, embodiments of the present invention will be described with reference to the accompanying drawings. It should be understood that the embodiments described in the following are intended only to illustrate the present invention and are not intended to limit the present invention.

Figure 1:
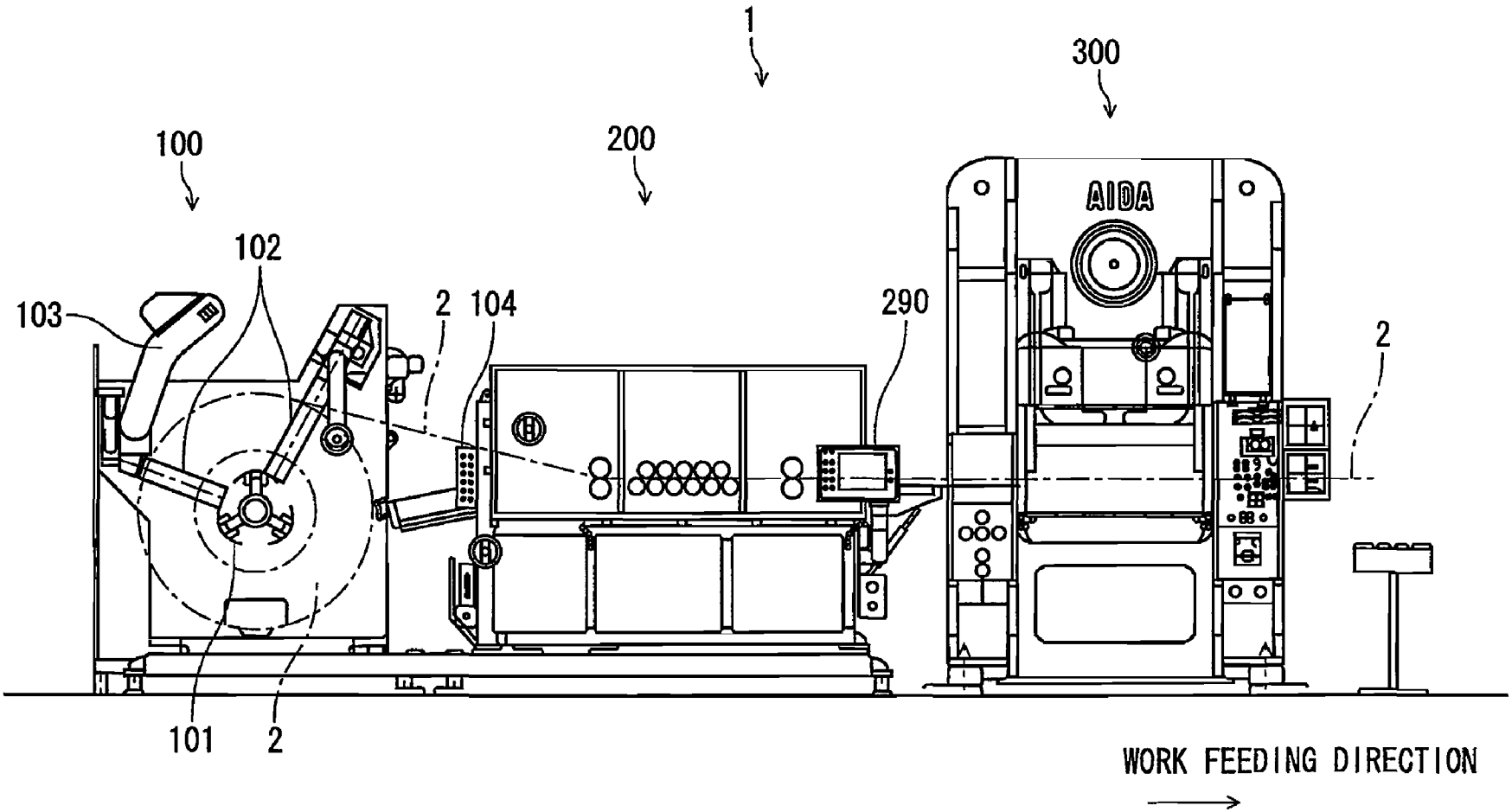
FIG. 1 is a diagram showing an overall structure of an automatic press apparatus according to one embodiment of the present invention.

Referring to FIG. 1, an automatic press apparatus 1 according to an embodiment of the present invention includes an uncoiler portion 100 that passes out a work object 2 wound in a coil configuration to a straightener feeder portion 200 disposed downstream thereof with respect to the flow of the working process, the straightener feeder portion 200 that receives the work object 2 passed out from the uncoiler portion 100 and passes out it to a press portion 300 downstream thereof with respect to the flow of the working process while leveling deformation such as curling of the work object 2 and the press portion 300 that performs press work on the work object 2 passed out from the straightener feeder portion 200.

The uncoiler portion 100 has a drum 101 on which the long work object 2 wound in a coil configuration is supported. The drum 101 is rotated by an electric motor or the like to feed the work object 2 to the straightener feeder portion 200 by a predetermined amount. The uncoiler portion 100 also has side guides 102 that support the work object 2 wound on the drum 101 from its lateral sides to prevent the work object 2 from losing its neatly wound shape and a coil holding member 103 for preventing uncoiling action of the leading edge of the work object 2 from occurring upon threading of the work object 2 and upon rewinding and for preventing the coil configuration from being loosened.

Figures 10A, 10B:
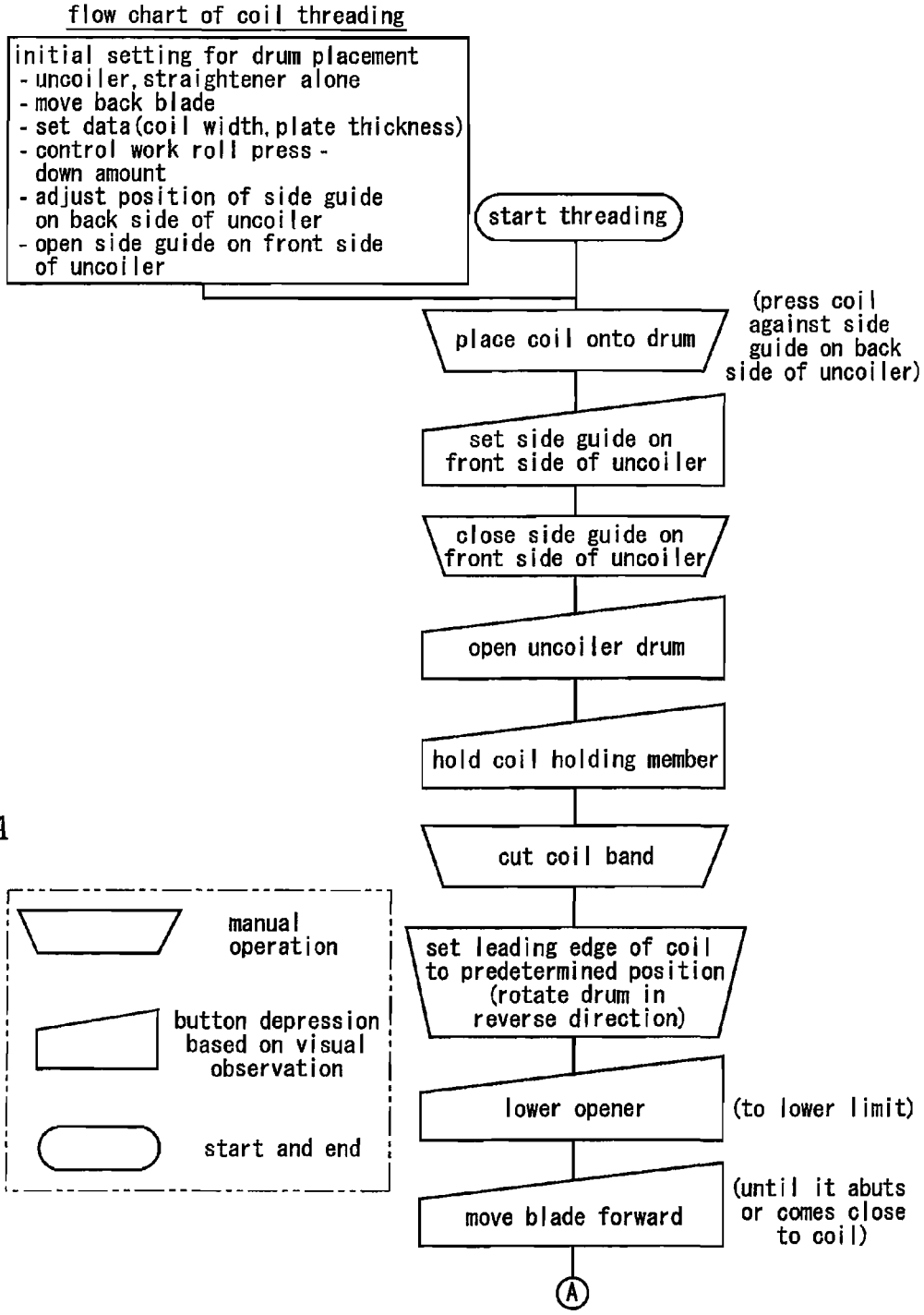
FIGS. 10A, 10B and 10C are a flow chart illustrating the threading process according to the present invention.
Figure 10C:
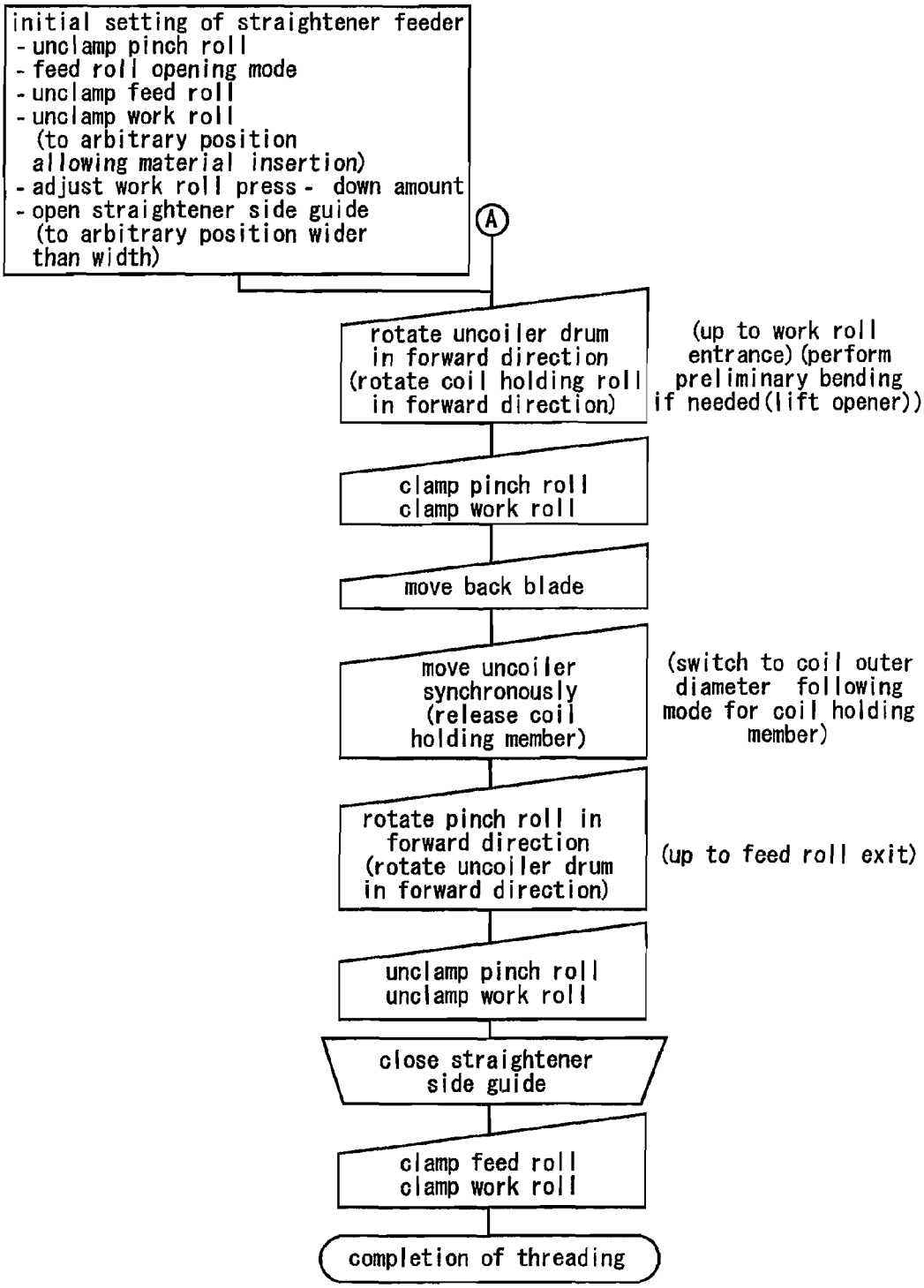

Operations of various portions of the uncoiler portion 100 are controlled by an uncoiler control apparatus 104. The various portions of the uncoiler portion 100 are controlled based, for example, on commands entered by an operator (operating person) into the uncoiler control apparatus 104 upon threading the work object 2 (see FIGS. 10 and 11).

Figure 2:
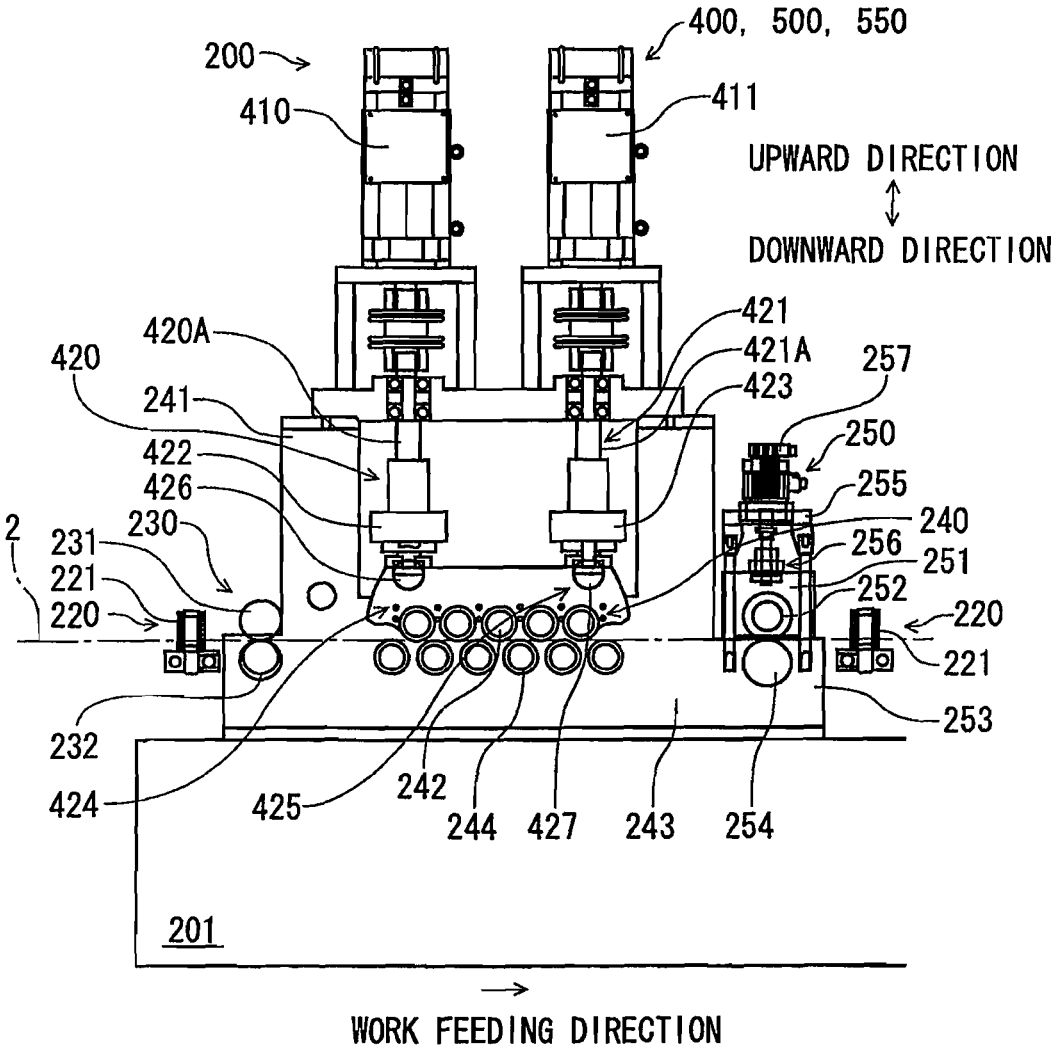
FIG. 2 illustrates a straightener feeder portion of the apparatus according to the embodiment of FIG. 1.

As shown in FIG. 2, the straightener feeder portion 200 has side guides 220, a pinch roll portion 230, a work roll portion 240 and a feed roll portion 250.

The side guides 220 are adapted to guide the lateral sides of the work object 2 fed into the pinch roll portion 230 of the straightener feeder portion 200 so as to prevent lateral fluctuation (or lateral movement) of the work object 2. The side guides 220 include rotatable rolls 221 that guide the lateral sides of the work object 2. The side guides 220 are also provided on the exit side of the feed roll portion 250, so that lateral fluctuation of the work object 2 is prevented from occurring.

The pinch roll portion 230 is adapted to pinch, upon threading of the work object 2, a portion of the work object 2 fed by the uncoiler portion 100 near the leading edge thereof with the upper pinch roll 231 and the lower pinch roll 232 on the front side and the back side of the work object 2 and capable of pressing the work object 2 with a predetermined (or desired) pressing force to clamp it. (Here and hereinafter, components on the front side of the work will be referred to as "upper" components, and components on the back side of the work object will be referred to as "lower" components.) The pinch roll portion 230 is also adapted to pass out the work object 2 to the work roll portion 240 disposed downstream thereof by a rotational force of the upper pinch roll 231 that is driven by an electric motor (not shown) to rotate.

In the pinch roll portion 230, clamping of the work object 2 held between the upper pinch roll 231 and the lower pinch roll 232 is achieved by pressing an output member of a cylinder (not shown) connected to the lower pinch roll 232 upwardly by a predetermined pressing force in order to prevent backward movement of the work object 2 from occurring upon automatic work release or upon power shut down.

At least one of the upper pinch roll 231 and the lower pinch roll 232 is equipped with a one-way bearing, and the pinch roll portion 230 in this embodiment has a function of a back stop roll (or anti-retrogression roll or the like) in addition to the above described clamping function.

The work roll portion 240 has a plurality of upper work rolls 242 that are supported on an upper frame 241 by an upper work roll support member 430 and driven by an electric motor or the like and a plurality of lower work rolls 244 that are provided on an lower frame (which constitutes the back side work roll support member) 243 and driven by an electric motor or the like (not shown). The upper work rolls 242 and the lower work rolls 244 are arranged alternately with their rotation centers being offset from each other (in a staggered pattern) along the work feeding direction as shown in FIG. 2.

In the work roll portion 240 having the above described structure, the upper work rolls 242 and the lower work rolls 244 cooperate to correct (or level) deformation such as winding strain of the work object 2 that is passing between the upper work rolls 242 and the lower work rolls 244.

The rotational driving of the upper work rolls 242 and the lower work rolls 244 is controlled by a control apparatus 290 in conjunction (or synchronized) with the rotation of the feed roll portion 250 that will be described later.

The straightener feeder portion 200 according to this embodiment is provided with an automatic release mechanism 400, an opening mechanism 500 and a pressing-down mechanism 550. Details of these mechanisms will be described later.

In the press portion 300 disposed downstream with respect to the flow of the working process, it is necessary to perform positioning of the work object 2 passed from the straightener feeder portion 200, before performing press work on it. In connection with this, in order to achieve precise positioning and prevent deformation of the work object 2, upon positioning the work object 2, it may be released automatically from the work roll portion 240 and from the feed roll portion 250 in the straightener feeder portion 200 in synchronization with the positioning operation so as to be set free in the plane of the work object 2 or with respect to the work object 2 feeding direction.

Similarly, at the time of press work that involves deformation of the work, the work object 2 may be released automatically from the work roll portion 240 and the feed roll portion 250 in synchronization with the press work. To this end, the automatic release mechanism 400 is provided.

It is also beneficial if the straightener feeder portion 200 is capable of performing an opening operation, that is, the operation of opening (separating, or spacing apart) the upper work rolls 242 and the lower work rolls 244 to a relatively large extent at the time when the leading edge of the work object 2 is inserted into the pinch roll portion 230 and the work roll portion 240 in the straightener feeder portion 200 upon threading of the work object 2 or at the time when maintenance such as cleaning of the rolls or other portions is to be performed as occasion demands. To this end, the opening mechanism 500 is provided.

In addition, it is advantageous if the straightener feeder 200 is capable of adjusting the work object 2 press-down amount by changing the relative position of the upper work rolls 242 to the lower work rolls 244 with respect to the vertical (or up and down) direction so that optimal leveling processing can be performed on the work object 2 according to variations in various factors such as the thickness, material of the work object 2 and/or the degree of deformation of the work object 2 when correction of deformation (or leveling) of the work object 2 is performed in the work roll portion 240. To this end, the pressing-down mechanism 550 is provided.

The work 2 that has been leveled in a predetermined manner in the straightener feeder portion 200 is fed into the feed roll portion 250 disposed downstream with respect to the flow of the working process. The feed roll portion 250 is adapted to be capable of sending out the work object 2 to the press portion 300 at a set feeding speed in synchronization with the press work operation of the press portion 300 that performs press work. The feed roll portion 250 has an upper feed roll 252 supported by an upper feed roll support member 251 and a lower feed roll 254 supported by a lower frame 253.

The aforementioned upper feed roll support member 251 is supported by an upper frame 255 in such a way as to be slidable with respect to the vertical direction and connected to a ball screw portion 256 mounted on the upper frame 255. When the work object 2 is to be sent out, an electric motor 257 or the like is driven, under control of the control apparatus 290, to move the upper feed roll support member 251 together with the upper feed roll 252 downwardly by means of the ball screw portion 256 so that the work object 2 can be held between the upper feed roll 252 and the lower feed roll 254 with a predetermined pressing force.

Upon releasing the work object 2 automatically in synchronization with press work in the press portion 300, the control apparatus 290 is configured to drive the electric motor 257 or the like to move the upper feed roll support member 251 and the upper feed roll 252 by means of the ball screw portion 256 to thereby release the work object 2.

On the downstream side of the feed roll portion 250, there may be provided a measuring roll that measures the actual length of the work object 2 fed by the feed roll portion 250 to obtain data on an error caused by sliding etc. to be fed back to the positioning process or press work process in the press portion 300.

On the downstream side of the measuring roll, there may be provided a lubricant application apparatus for applying a lubricant such as a lubricating oil to the work object 2 to prevent galling of the die due to resistance from occurring when press work is performed on the work object 2.

The work object 2 sent out by the feed roll portion 250 is fed to the press portion 300 disposed downstream, where press work is performed on the work object 2.

In the following, the automatic release mechanism 400 of the straightener feeder portion 200 according to this embodiment will be described in detail.

The automatic release mechanism 400 includes two servo motors 410 and 411 that can rotate in the forward and reverse directions, two ball screw portions 420 and 421 provided in association with the servo motors 410 and 411 respectively and the upper work roll support member (or the front side work roll support member) 430 supported by the ball screw portions 420, 421.

In this embodiment, the automatic release mechanism 400 also functions as the opening mechanism 500 and the pressing-down mechanism 550 as will be described later.

The ball screw portions 420, 421 are mounted on the upper frame 241, which in turn is mounted substantially integrally on the main frame 201. The ball screw portions 420, 421 are adapted to convert rotational movement of the servo motors 410, 411 into back and forth movement of the output members 422, 423. The output members 422, 423 are connected to the upper work roll support member 430 via link portions 424, 425 composed of ball joints 426, 427 and other members.

In order to prevent displacement of the upper work roll support member 430 caused by a force exerted thereon from the work object 2 in the work feeding direction, the side surfaces of the upper work roll support member 430 may be supported by means of a linear guide or the like so that it can slide in the vertical direction in FIG. 2 relative to the upper frame 241.

In this embodiment, when a release signal is sent to each of the servo motors 410, 411 in synchronization with press work performed in the press portion 300, the servo motors 410, 411 are rotated in a predetermined manner. The output members 422, 423 are screwed to ball screws 420A, 421A of the ball screw portions 420, 421 but regulated in such a way as not to rotate with the rotation of the ball screws 420A, 421A. Thus, with the rotation of the servo motors 410, 411, the output members 422, 423 are moved in the release direction, namely in the upward direction from their clamping position shown in FIG. 2.

Since the output members 422, 423 as described above are connected to the upper work roll support member 430 by means of the ball joints 426, 427 of the link portions 424, 425 as shown in FIG. 2, the upper work roll support portion 430 is moved in the release direction shown in FIG. 2 with the movement of the output members 422, 423 in the release direction, whereby the upper work rolls 242 supported on the upper work roll support member 430 are displaced in the release direction. Thus, the upper work rolls 242 are spaced apart from the lower work rolls 244 by a predetermined distance, whereby the work object 2 is released.

In synchronization with the release operation in the work roll portion 240, the control apparatus 290 also controls the feed roll portion 250 to cause it to release the work object 2.

However, the pinch roll portion 230 does not perform release operation, but it functions as back stop rolls (or anti-retrogression rolls) so as to prevent backward movement of the work object 2 at the time when the work object 2 is released by the release operations in the work roll portion 240 and the feed roll portion 250 (i.e. at the time of automatic release). In the case where press work that does not require release of the work object 2 in the work roll portion 240 and the feed roll portion 250 is performed (i.e. in the case where automatic release is not performed), the pinch roll portion 230 may release the work object 2.

To terminate the released state to perform leveling processing on the work object 2 and feed it, the servo motors 410, 411 are caused to rotate by a predetermined amount in the direction opposite to the rotation in the release operation thereby moving the output members 422, 423 of the ball screw portions 420, 421 in the downward direction in FIG. 2 to the clamping position (or the unreleasing position).

With this movement of the output members 421, 422 to the clamping (or unreleasing) position, the upper work roll support member 430 is moved in the downward direction (unreleasing direction) in FIG. 2. Thus, the upper work rolls 242 supported on the upper work roll support member 430 comes in contact with the work object 2 with a predetermined press-down amount, whereby the upper work rolls 242 are returned to the state in which they can perform leveling processing on the work 2 object.

In synchronization with the above-described released state termination operation in the work roll portion 240, the control apparatus 290 also controls the feed roll portion 250 to terminate the released state of the work object 2 to clamp it, whereby the work 2 object is brought into a conveyable state.

The control apparatus 290 may be configured to be capable of controlling the servo motors 410 and 411 independently from each other.

As described above, in this embodiment, the rotational movements of the servo motors 410, 411 are converted into the back and forth movements of the output members 422, 423 of the ball screw portions 420, 421, and the release operation is performed utilizing the back and forth movements. Accordingly, the release operation can be performed with improved response as compared to conventional arrangements in which the release operation is performed using a cylinder, and improvement in working environment can be achieved thanks to a reduction in noise.

Here, the ball screw portions 420, 421 constitute the conversion means in the present invention.

Next, the opening mechanism 500 according to this embodiment will be described in detail.

As has already been described, the opening mechanism 500 is adapted to perform the opening operation in which the upper work rolls 242 and the lower work rolls 244 are spaced apart to a relatively large extent at the time when the leading edge of the work 2 is to be inserted into the pinch roll portion 230 and the work roll portion 240 in the straightener feeder portion 200 upon threading of the work 2 or at the time when maintenance such as cleaning of the rolls or other portions is to be performed. In this embodiment, the release mechanism 400 also functions as the opening mechanism 500. Thus, the opening mechanism 500 is composed of the two servo motors 410, 411, the two ball screws 420, 421 provided in association with the servo motors 410, 411 respectively and the upper work roll support member (or the front side work roll support member) 430 supported on the ball screw portions 420, 421.

Specifically, in the opening operation, when an opening start signal is sent from the control apparatus 290 according to a command entered by an operator or the like, the servo motors 410, 411 are rotated in a predetermined manner. With the rotation of the motors 410, 411, the output members 422, 423 that are screwed to the ball screws 420A, 421A of the ball screw portions 420, 421 are displaced to a relatively large extent in the upward direction from their clamping position shown in FIG. 2. The control apparatus 290 may be configured to be capable of controlling the servo motors 410, 411 independently from each other.

Since the above described output members 422, 423 are connected to the upper work roll support members 430 via the ball joints 426, 427 in the link portions 424, 425, the relatively large displacement of the output members 422, 423 in the upward direction in FIG. 2 causes the upper work roll support member 430 and the upper work rolls 242 to be displaced in the upward direction in FIG. 2, whereby the opening operation, or the operation of spacing apart the upper work rolls 242 and the lower work rolls 244 to a relatively large extent is achieved. Thus, a space large enough to allow threading or maintenance work such as cleaning of rolls is formed between the upper work rolls 242 and the lower work rolls 244.

After completion of threading or maintenance work such as cleaning of rolls, when an opening termination signal is sent from the control apparatus 290 according to a command entered by the operator or the like, the servo motors 410, 411 are caused to rotate by a predetermined amount in the direction opposite to the rotation in the opening operation thereby moving the upper work roll support member 430 and the upper work rolls 242 in the downward direction in FIG. 2 to terminate the opened state. Thus, the upper work rolls 242 comes in contact with the work 2 object with a predetermined pressure, whereby the upper work rolls 242 are returned to the state in which they can perform leveling processing on the work 2 object.

Next, the pressing-down mechanism 550 in the straightener feeder portion 200 according to this embodiment will be described.

As described before, the pressing-down mechanism 550 is a mechanism adapted to adjust the work 2 object press-down amount by changing the position of the upper work rolls 242 relative to the lower work rolls 244 in the vertical direction so that optimal leveling processing can be performed on the work 2 object according to variations in the thickness of the work 2 object fed or other factors when leveling processing is performed on the work 2 object in the work roll portion 240.

In this embodiment, the release mechanism 400 also functions as the pressing-down mechanism 550. Thus, the pressing-down mechanism is composed of the two servo motors 410, 411, the two ball screws 420, 421 provided in association with the servo motors 410, 411 respectively and the upper work roll support member (or the front side work roll support member) 430 supported on the ball screw portions 420, 421.

In the pressing-down mechanism 550 according to this embodiment, when a control signal is sent from the control apparatus 290 in response to a command for increasing (or decreasing) the pressing-down amount entered by the operator or the like, the servo motors 410, 411 are rotated in a predetermined manner. With the rotation of the servo motors 410, 411, the output members 422, 423 that are screwed to the ball screws 420A, 421A of the ball screw portions 420, 421 are moved in the upward (or downward) direction in FIG. 2 from the clamping state shown in FIG. 2.

With the movement of the output members 422, 423, the upper work roll support member 430 and the upper work rolls 242 are moved upwardly (or downwardly), whereby the relative position of the upper work rolls 242 and the lower work rolls 244 is adjusted. Thus, the pressing down amount of the upper work rolls 242 against the work object 2 disposed between the upper work rolls 242 and the lower work rolls 244 can be adjusted to a desired value. The control apparatus 290 may be configured to be capable of controlling the servo motors 410 and 411 independently from each other.

Accordingly, the pressing-down mechanism 550 according to this embodiment can adjust the pressing-down amount to an optimal value as demanded or according to variations in the thickness and/or material of the work object 2 with a relatively simple structure. Thus, desired leveling processing can be performed.

As per the above, according to this embodiment, the release mechanism 400, the opening mechanism 500 and the pressing-down mechanism 550 are composed of the servo motors 410, 411, the ball screw portions 420, 421 provided in association with the respective servo motors 410, 411 and the upper work roll support member (or the front side work roll support member) 430 supported by the ball screw portions 420, 421. Therefore, the structure can be made simple, and the release operation, opening operation and pressing-down operation can be performed with improved response as compared to conventional arrangements in which these operations are performed using a cylinder. In addition, improvement in working environment can be achieved thanks to a reduction in noise.

In this embodiment, since the ball joints 426, 427 are used in the link portions 424, 425 of the output members 422, 423 and the upper work roll support member 430, the upper roll support member 430 can be inclined in the plane corresponding to the plane of the drawing sheet of FIG. 2. Accordingly, the work object 2 pressing-down amount can be made different between the entrance side and the exit side, whereby the degree of freedom of work 2 leveling process and precision of the leveling process can be enhanced.

Even when there are small erroneous differences (such as errors in the moving speed, errors in the movement start time and/or errors in the movement amount) between the servo motor 410 and the servo motor 411, between the ball screw portion 420 and the ball screw portion 421 and/or between the output member 422 and the output member 423, and even when there is an inclination variation between the upper work rolls 242 and the lower work rolls 244, the variations can be effectively absorbed by the ball joints 426, 427. Therefore, the release operation, opening operation and the pressing-down operation can be performed smoothly at a relatively high speed and with high response, and precise leveling process can be achieved.

The ball screws 420A, 421A in the ball screw portions 420, 421 may be threaded in the same direction or in opposite directions. In the case where they are threaded in the opposite directions, for example, reactive torques generated upon driving the servo motor 410 and the servo motor 411 can be cancelled, and the output member 422 and the output member 423 can be moved more smoothly at a relatively high speed and with high response.

Although in the embodiment described in the foregoing use is made of the servo motors 410, 411, the present invention is not limited to the use of servo motors, but what is essential is that use is made of at least one electric motor, and other types of motors may also be used so long as they are constructed in such a way that factors such as the speed and the rotation amount can be controlled in forward and reverse rotations (or both rotation directions) and satisfy requirements placed thereon.

The ball screw portions 420, 421 are not limited to ball screw mechanisms, but other mechanisms or structures that can convert rotational movement of electric motors or the like into output back and forth movement may also be used. For example, a combination of an electric motor and a gear mechanism (e.g. rack and pinion gears) may be used to enable back and forth movement of the output members.

Although in this embodiment the two servo motors 410, 411 and the two ball screw portions 420, 421 are provided side by side and the upper work roll support portion 430 is supported by these two sets of servo motors and ball screw portions, the present invention is not limited to this structure. For example, one of the two sets of servo motors and ball screw portions may be eliminated, and the upper work roll support member 430 may be supported on the upper frame 241 or other portion in a swingable manner at a point near one end thereof so that the release of the work 2 object and the opening operation can be performed by swinging the upper work roll support portion 430 about a swing shaft with back and forth movement of the output member. In this case, however, the function of the pressing-down mechanism cannot be achieved only by the above described structure, and a pressing-down mechanism, for example, according to the second embodiment described in the following will be implemented.

In the following, another embodiment of the present invention will be described in detail with reference to FIGS. 3 and 4.

This embodiment differs from the above-described embodiment only in the structure of the straightener feeder portion 700, and accordingly the following description will be made of the straightener feeder portion 700. Like elements are denoted by like reference signs, and no detailed description thereof will be made.

The straightener feeder portion 700 according to this embodiment includes a servo motor 710, a ball screw portion 720 connected to the servo motor 710 and an upper work roll support portion (or front side work roll support portion) 730 that is supported on the ball screw portion 720 by means of the support member 731 provided between them.

The ball screw portion 720 is adapted to convert rotational movement of the servo motor 710 mounted on an upper frame 241 that is integral with a main frame 201 into back and forth movement of an output member 721. The output member 721 is attached to the support member 731 by means of fastening elements such as screws.

Figure 3:
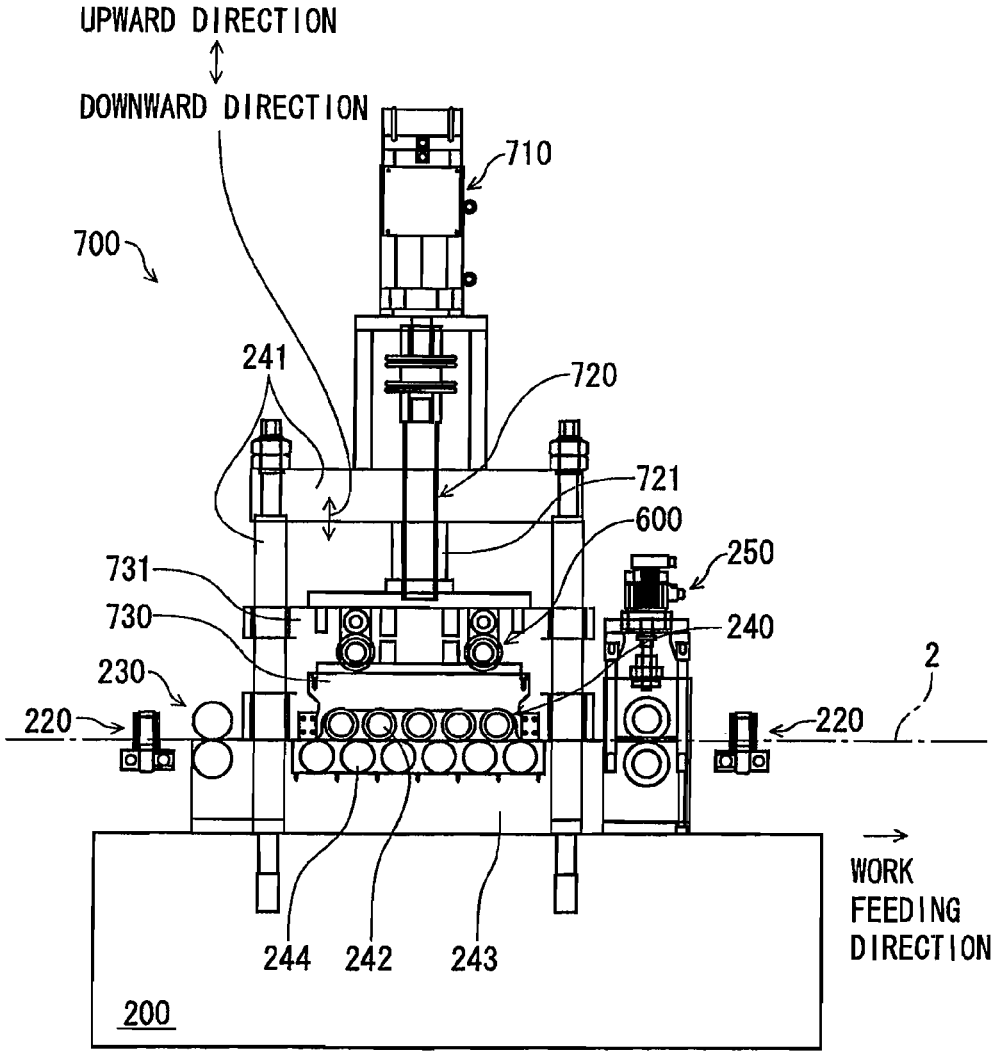
FIG. 3 illustrates a straightener feeder portion according to another embodiment of the present invention.

The upper work roll support member 730 is supported by the support member 731 via a bearing or the like in such a way that it can slide in the vertical direction in FIG. 3 relative to the upper frame 241.

In the following, a release mechanism in the straightener feeder portion 700 according to this embodiment will be described.

When a release signal is sent to the servo motor 710 in synchronization with, for example, press working in the press portion 300, the servo motor 710 is rotated in a predetermined manner. With the rotation of the servo motor 710, the output member 721 of the ball screw portion 720 is moved from the clamping position shown in FIG. 3 in the releasing direction, namely in the upward direction in FIG. 3.

Figure 4:
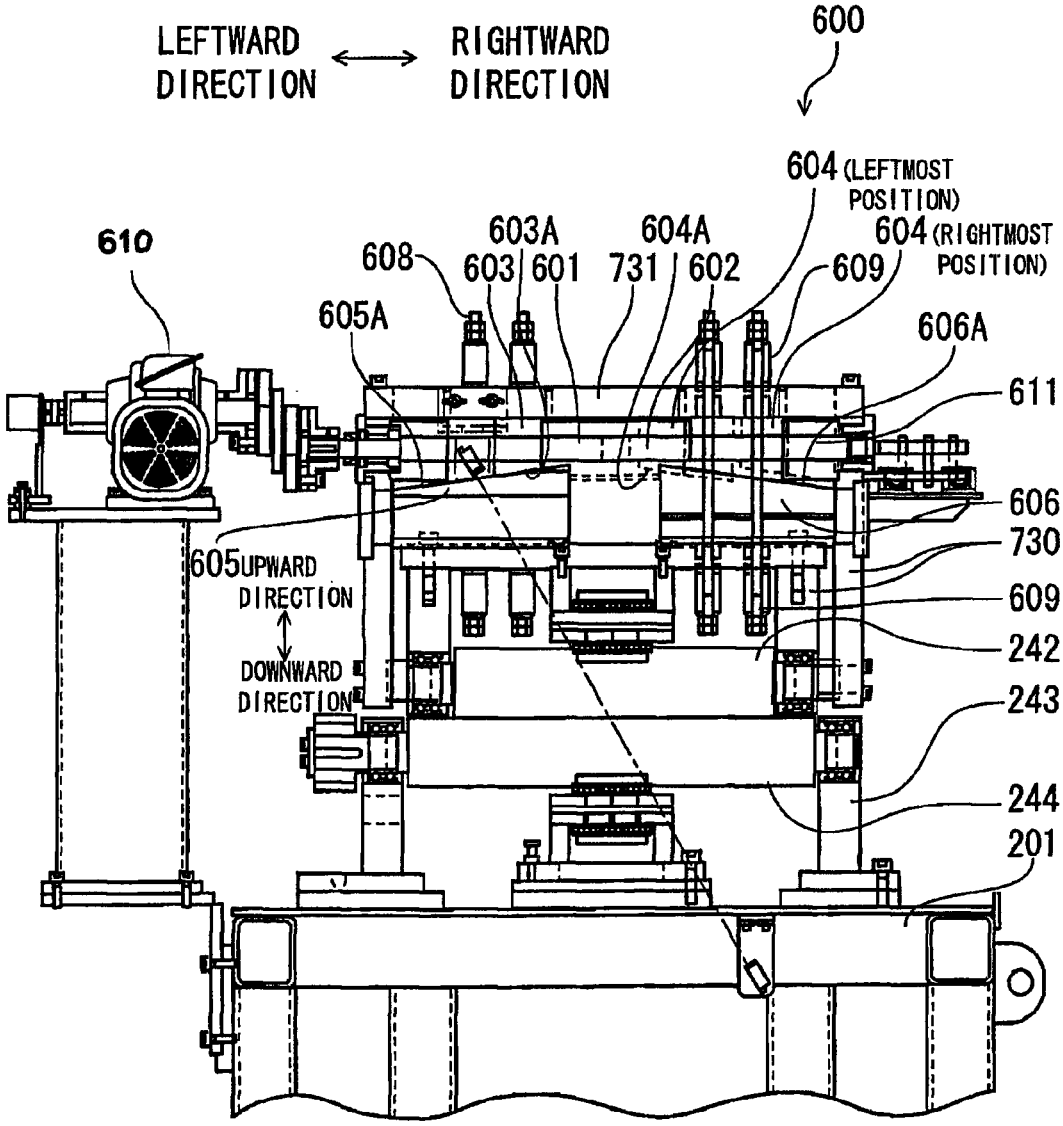
FIG. 4 is an enlarged view illustrating a pressing-down mechanism according to the embodiment of FIG. 3.

Since the output member 721 as descried above is supporting the upper work roll support member 730 via the support member 731 as shown in FIGS. 3 and 4, the upper work roll support member 730 is moved in the releasing direction or the upward direction in the drawings with the movement of the output member 721 in the releasing direction, whereby the upper work rolls 242 supported on the upper work roll support member 730 are moved in the releasing direction, or the upward direction in FIG. 3, and spaced apart from the lower work rolls 244 by a predetermined distance. Thus, the work object 2 is released.

In synchronization with the release operation in the straightener feeder portion 700, the control apparatus 290 also controls the feed roll portion 250 to cause it to release the work object 2.

To terminate the released state to perform leveling processing on the work object 2 and feed it, the servo motor 710 is caused to rotate by a predetermined amount in the direction opposite to the rotation in the release operation thereby moving the output member 721 of the ball screw portion 720 to the clamping position (or the unreleasing position) shown in FIG. 3.

With this movement of the output member 721 to the clamping (or unreleasing) position, the upper work roll support member 730 is moved in the downward direction (unreleasing direction) in FIG. 3. Thus, the upper work rolls 242 supported on the upper work roll support member 730 comes in contact with the work object 2 with a predetermined press-down amount, whereby the upper work rolls 242 are returned to the state in which they can perform a leveling processing on the work object 2.

In synchronization with the above-described released state termination operation in the straightener feeder portion 700, the control apparatus 290 also controls the feed roll portion 250 to terminate the released state of the work object 2 to clamp it, whereby the work object 2 is brought into a conveyable state.

As described above, in this embodiment, rotational movement of the servo motor 710 is converted into back and forth movement of the output member 721 of the ball screw portion 720, and the release operation is performed by utilizing the back and forth movement. Thus, even with a simple structure, the release operation can be performed with improved response as compared to conventional arrangements in which the release operation is performed using a cylinder, and improvement in working environment can be achieved thanks to a reduction in noise.

In this embodiment, the ball screw portion 720 constitutes the conversion means in the present invention, and the upper work roll support member 730 and the support member 731 constitute the front side work roll support member in the present invention.

Next, the opening mechanism according to this embodiment will be described in detail. In this embodiment, the above described release mechanism also functions as the opening mechanism.

In the opening operation in this embodiment, when an opening start signal is sent from the control apparatus 290 according to a command entered by an operator or the like, the servo motor 710 is rotated in a predetermined manner. With the rotation of the servo motor 710, the output member 721 of the ball screw portion 720 is displaced from the clamping position shown in FIG. 3 to a relatively large extent in the upward direction in FIG. 3.

Since the output member 721 as described above is connected to the upper work roll support member 730 via the support member 731, the relatively large displacement of the output member 721 in the upward direction in FIG. 3 causes the upper work roll support member 730 and the upper work rolls 242 to be displaced to a relatively large extent in the upward direction in FIG. 3, whereby the opening operation, or the operation of spacing apart the upper work rolls 242 and the lower work rolls 244 to a relatively large extent is achieved. Thus, a space large enough to allow threading or maintenance work such as cleaning of rolls is formed between the upper work rolls 242 and the lower work rolls 244.

After completion of the threading or maintenance work such as cleaning of rolls, when an opening termination signal is sent from the control apparatus 290 according to a command entered by the operator or the like, the servo motor 710 is caused to rotate by a predetermined amount in the direction opposite to the rotation in the opening operation thereby moving the upper work roll support member 730 and the upper work rolls 242 in the downward direction in FIG. 3 to terminate the opened state. Thus, the upper work rolls 242 comes in contact with the work object 2 with a predetermined pressure, whereby the upper work rolls 242 are returned to the state in which they can perform leveling processing on the work object 2.

Next, the pressing-down mechanism in the straightener feeder portion 700 according to this embodiment will be described.

As shown in FIG. 4, the pressing down mechanism 600 according to this embodiment includes trapezoidal screw portions 601, 602, an electric motor 610 that is driven by a control signal sent from the control apparatus 290 according to a press-down amount increase (or decrease) command entered by the operator or the like to supply rotational drive to the trapezoidal screw portions 601, 602, upper taper blocks 603, 604 that are meshed with the trapezoidal screw portions 601, 602 and adapted to be movable toward or away from each other in the leftward and rightward directions in FIG. 4 with rotations of the trapezoidal screw portions 601, 602 and lower taper blocks 605, 606 having tapered surfaces 605A, 606A opposed to and in contact with tapered surfaces 603A, 604A of the upper taper blocks 603, 604 respectively. On the bottoms of the lower taper blocks 605, 606 are supported the upper work rolls 242.

As shown in FIG. 4, the lower taper blocks 605, 606 are supported by the support member 731 by means of through bolts 608, and the upper work rolls 242 are supported by the lower taper blocks 605, 606 via the upper work roll support member 730. The mechanism is also provided with springs 609 through which the trough bolts 608 are passed. The springs 609 provide elastic support for the lower taper blocks 605, 606 and the upper work roll support member 730 etc. on the support member 731.

The trapezoidal screw portion 601 and the trapezoidal screw portion 602 are formed on a common shaft 611 and threaded in directions opposite to each other. Thus, when the shaft 611 is rotated by the electric motor 610 in a predetermined direction by a predetermined amount, one upper taper block 603 screwed to one trapezoidal screw portion 601 and the other upper taper block 604 screwed to the other trapezoidal screw portion 602 are moved on the shaft 611 in directions toward each other by a predetermined amount, and when the shaft 611 is rotated in the direction opposite to the aforementioned predetermined direction by a predetermined amount, the upper taper block 603 and the upper taper block 604 are moved on the shaft 611 in directions away from each other by a predetermined amount.

Accordingly, when for example, the upper taper block 603 (604) is moved in the rightward (leftward) direction in FIG. 4, a thrust force is exerted on the tapered surface 605A (606A) opposed to and in contact with the tapered surface 603A (604A) of that upper taper block 603 (604) in the rightward (leftward) direction in FIG. 4. By the equilibrium of forces on the tapered surface 605A (606A), a force acting in the downward direction in FIG. 4 is exerted on the tapered surface 605A (606A) of the lower taper block 605 (606), so that the lower taper block 605 (606) is moved by a predetermined amount in the downward direction in FIG. 4.

The upper work rolls 242 are supported on the lower taper blocks 605, 606 via the upper work roll support member 730, and when the lower taper blocks 605, 606 are moved in the downward direction in FIG. 4 resisting against the bias force of the springs 609, the work rolls 242 are also moved in the downward direction in FIG. 4 by a predetermined amount. Thus, the press-down amount of the upper work rolls 242 against the work 2 object disposed between the upper work rolls 242 and the lower work rolls 244 rotatably mounted on the lower frame 243 can be increased by a predetermined amount.

Conversely, when the upper taper block 603 (604) is moved in the leftward (rightward) direction in FIG. 4, the thrust force acting on the tapered surface 605A (606A) is weakened, and the upper taper block 603 (604) is moved in the upward direction in FIG. 4. With this movement of the upper taper block 603 (604), the upper work rolls 242 are moved in the upward direction in FIG. 4 by a predetermined amount, whereby the press-down amount of the upper work rolls 242 against the work object 2 can be decreased by a predetermined amount.

As per the above, according to the pressing-down mechanism 600 of this embodiment, adjustment of the press-down amount to an appropriate value can be achieved, by a relatively simple structure, according to a requirement or according to variations in, for example, the thickness and/or material of the work object 2, and leveling process can be performed in a desired manner.

Although in the embodiment described in the foregoing use is made of the servo motor 710, the present invention is not limited to the use of a servo motor, but what is essential is that use is made of at least one electric motor, and other types of motors may also be used so long as they are constructed in such a way that factors such as the speed and the rotation amount can be controlled in forward and reverse rotations (or both rotation directions) and satisfy requirements placed thereon.

The ball screw and the trapezoidal screws used in the ball screw portion and the trapezoidal screw portions in the above describe embodiment are not intended to limit the present invention, but other mechanisms or structures that can convert rotational movement of an electric motor or the like into output back and forth movement may also be used. For example, a combination of an electric motor and a gear mechanism (e.g. rack and pinion gears) may be used to enable back and forth movement of an output member.

Figure 5:
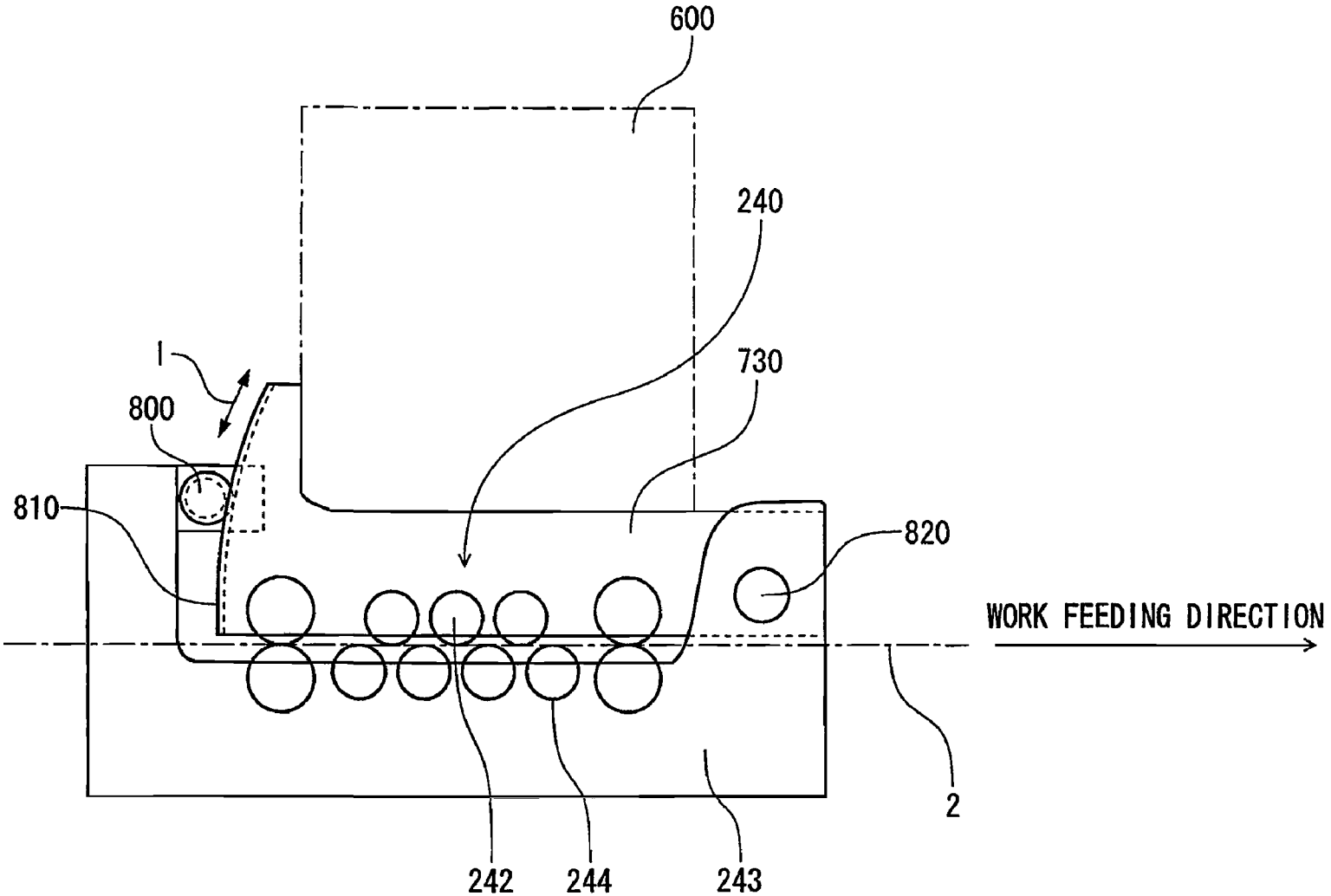
FIG. 5 is a diagram schematically showing a modification of the embodiment of FIG. 3.

Here, reference is made to FIG. 5, where elements similar to those in FIGS. 3 and 4 are designated by like reference signs. In the present invention, to achieve the release operation and the opening operation, a pinion gear 800 rotationally driven by a servo motor 710 and a rack gear 810 meshing with the pinion gear 800 may be used in place of the above described ball screw portion 720. For example, the rack gear 810 may be provided on the upper work roll support member 730, and the upper work roll support member 730 may be connected to the lower work roll support member 243 in a swingable manner by means of a swing shaft 820 so that the upper work roll support member 730 can reciprocate in the directions indicated by arrow I in FIG. 5 with forward and reverse rotation of the pinion gear 810 caused by the servo motor 710.

In this way, the upper work roll support member 730 is displaced relative to the lower work roll support member 243 utilizing forward and backward rotations of the servo motor 710, whereby the release operation and the opening operation can be achieved. Accordingly, even with a simple structure, the release operation and the opening operation can be performed with improved response as compared to conventional arrangements in which these operations are performed using a cylinder, and improvement in working environment can be achieved thanks to a reduction in noise.

It should be understood that the present invention is characterized in that the functions of a release mechanism, opening mechanism and pressing-down mechanism are achieved by displacing at least one of the upper (or front side) work roll support member that supports the upper (or front side) work roll(s) and the lower (or back side) work roll support member that supports the lower (or back side) work roll(s) relative to the other utilizing forward and reverse rotational movement of an electric motor or the like, and any mechanism or structure that has such features falls within the technical scope of the present invention.

Although embodiments in which the present invention is applied to a leveling apparatus for processing a work to be supplied to a press machine has been described in the foregoing, the present invention is not limited to such an apparatus. The present invention can also be applied to processing apparatus that performs a certain processing (e.g. plastic working such as forging, rolling or punching) other than press working on a work that has been wound in a coil configuration. The material of the work is not limited to a metal, but it may be other materials such as a resin that requires leveling.

In the following, a description will be made, with reference to accompanying drawings, of yet another embodiment, in which the functions of a release mechanism, opening mechanism and pressing-down mechanism are achieved by displacing at least one of the upper (or front side) work roll support member that supports the upper (or front side) work rolls and the lower (or back side) work roll support member that supports the lower (or back side) work rolls relative to the other utilizing forward and reverse rotational movement of an electric motor or the like. Elements similar to those in the two embodiments described above will be designated by like reference signs, and a description thereof will be omitted.

Figure 6:
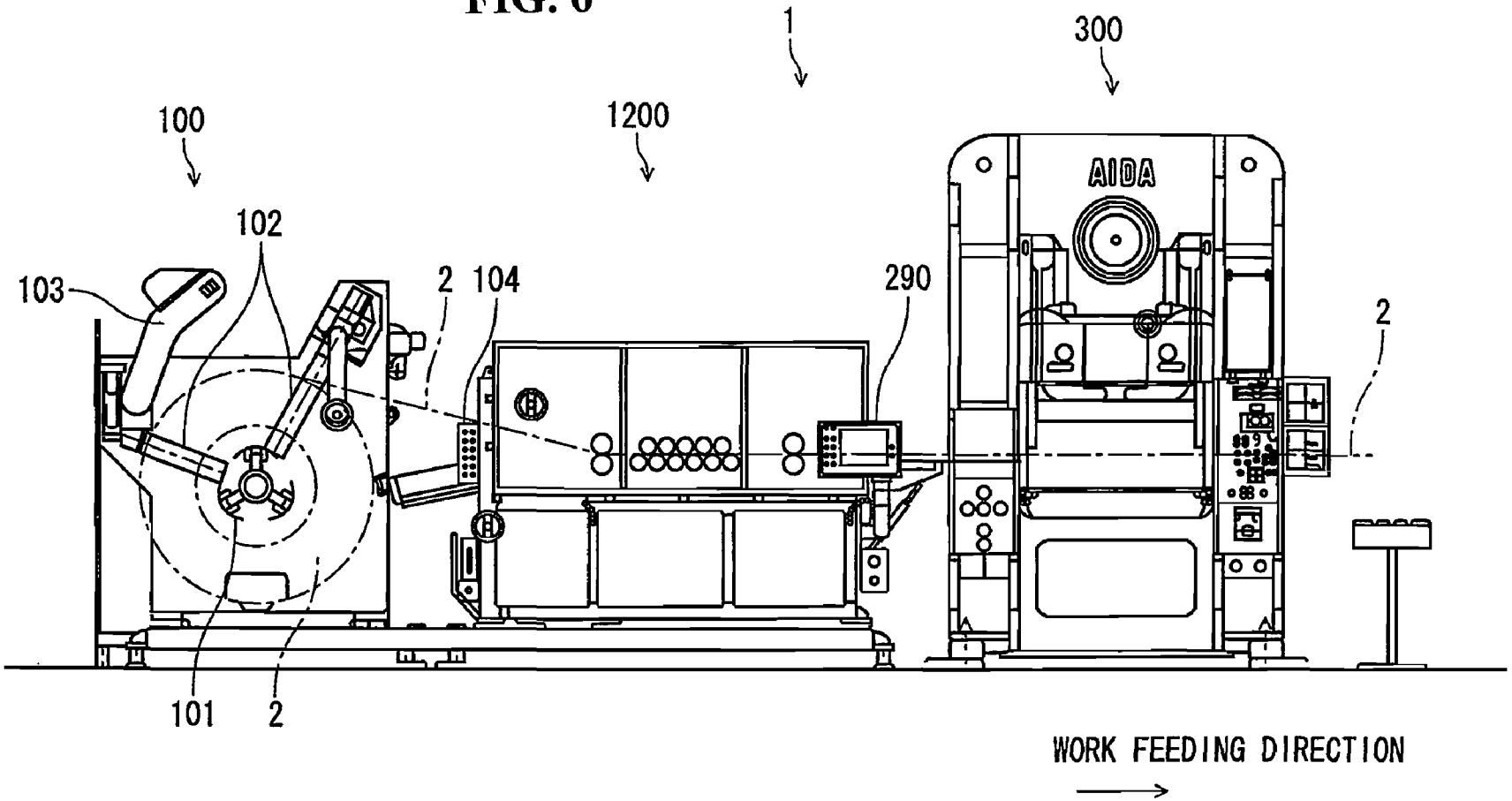
FIG. 6 is a diagram showing an overall structure of an automatic press apparatus according to yet another embodiment of the present invention.

As shown in FIG. 6, an automatic press apparatus 1 according to an embodiment has an uncoiler portion 100 that passes out a work object 2 wound in a coil configuration to a straightener feeder portion 1200 disposed downstream thereof with respect to the flow of the working process, the straightener feeder portion 1200 that receives the work object 2 passed out from the uncoiler portion 100 and passes out it to a press portion 300 downstream thereof with respect to the flow or the working process while leveling deformation such as curling of the work object 2 and the press portion 300 that performs press work on the work object 2 passed out from the straightener feeder portion 1200.

The uncoiler portion 100 has a drum 101 on which the long work object 2 wound in a coil configuration is supported. The drum 101 is rotated by an electric motor or the like to feed the work object 2 to the straightener feeder portion 1200 by a predetermined amount. The uncoiler portion 100 also has side guides 102 that support the work 2 wound on the drum 101 from its lateral sides to prevent the work object 2 from losing its neatly wound shape and a coil holding member 103 for preventing uncoiling action of the leading edge of the work object 2 from occurring upon threading of the work object 2 and upon rewinding and for preventing the coil configuration from being loosened.

Operations of various portions of the uncoiler portion 100 are controlled by an uncoiler control apparatus 104. The various portions of the uncoiler portion 100 are controlled based, for example, on commands entered by an operator into the uncoiler control apparatus 104 upon threading the work object 2 (see FIGS. 10 and 11).

Figure 7:
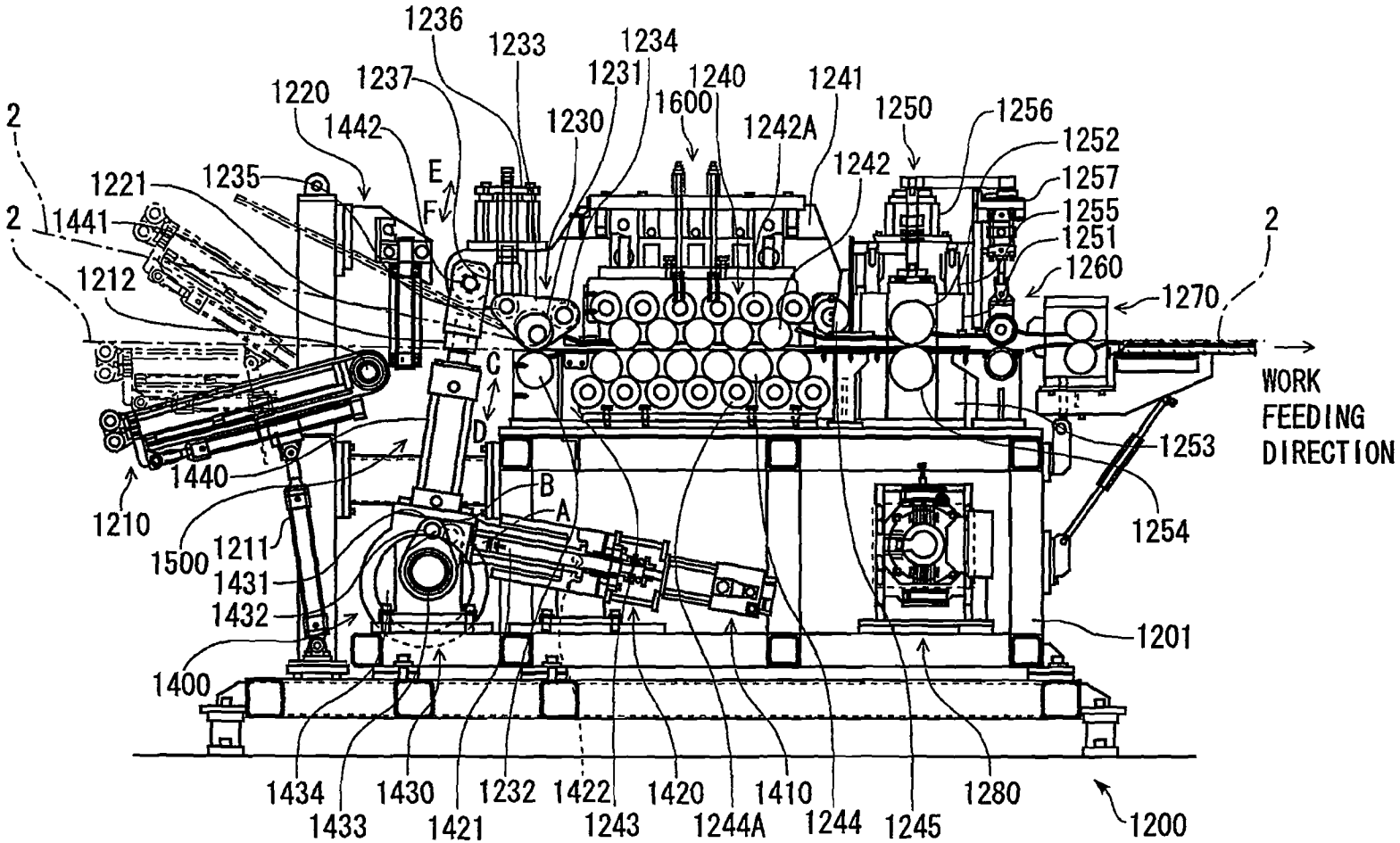
FIG. 7 illustrates a straightener feeder portion of the apparatus according to the embodiment of FIG. 6.

As shown in FIG. 7, the straightener feeder portion 1200 has an opener 1210, side guides 1220, a pinch roll portion 1230, a work roll portion 1240 and a feed roll portion 1250.

Upon threading of the work object 2, the opener 1210 is adapted to be swung by a hydraulic cylinder 1211 about a swing shaft 1212 to guide advancement of the leading edge of the work object 2 from the uncoiler portion 100 to the straightener feeder portion 1200. In addition, as shown in FIG. 7, the opener 1210 is adapted to be moved to an upper position by driving the hydraulic cylinder 1211 to perform edge bending processing on the leading edge of the work object 2 upon threading.

The side guides 1220 are adapted to guide the lateral sides of the work object 2 fed into the pinch roll portion 1230 of the straightener feeder portion 1200 so as to prevent lateral fluctuation (or lateral movement) of the work object 2. The side guides 220 include rotatable rolls 1221 that guide the lateral sides of the work object 2.

The pinch roll portion 1230 is adapted to pinch, upon threading of the work object 2, a portion of the work object 2 fed by the uncoiler portion 100, near the leading edge thereof with the upper pinch roll 1231 and the lower pinch roll 1232 on the front side and the back side of the work object 2 and capable of pressing the work object 2 with a predetermined pressing force to clamp it. (Here and hereinafter, components on the front side of the work will be referred to as "upper" components, and components on the back side of the work will be referred to as "lower" components.) The pinch roll portion 1230 is also adapted to pass out the work object 2 to the work roll portion 1240 disposed downstream thereof by a rotational force of the lower pinch roll 1232 that is rotationally driven.

The lower pinch roll 1232 is driven by an electric motor 1280 or the like according to a drive signal sent from the control apparatus 290 to rotate in a desired manner, while the upper pinch roll 1231 is rotatably mounted on a link member 1233.

Figure 8A:
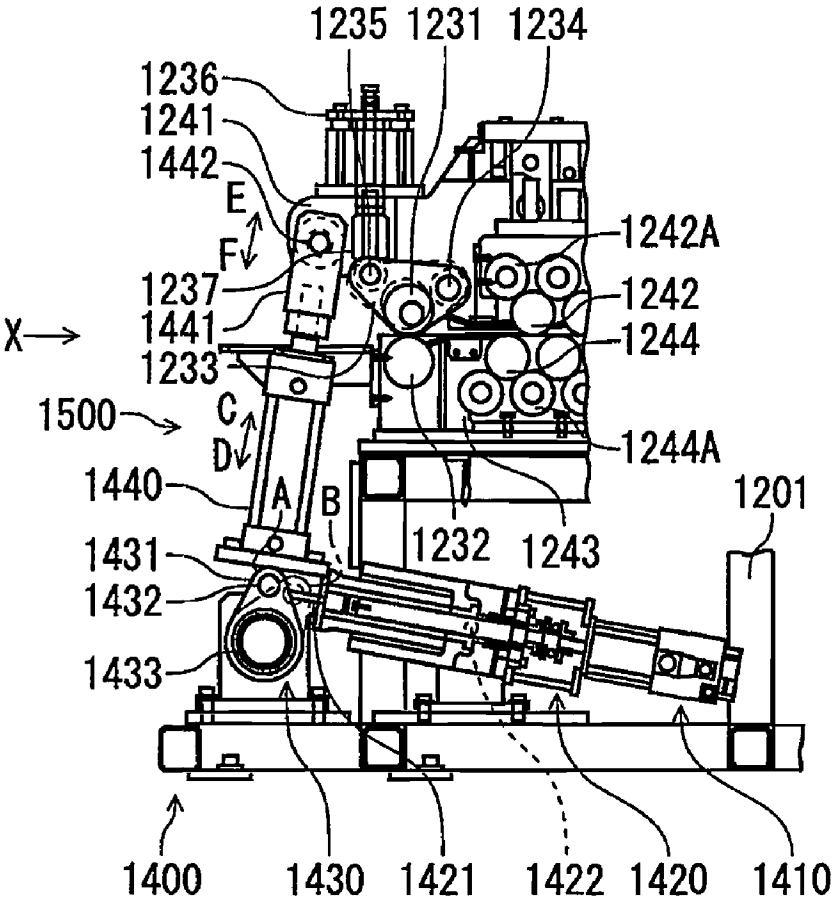
FIG. 8A is a front view showing an automatic release mechanism according to the embodiment of FIG. 6 in an enlarged manner.
Figure 8B:
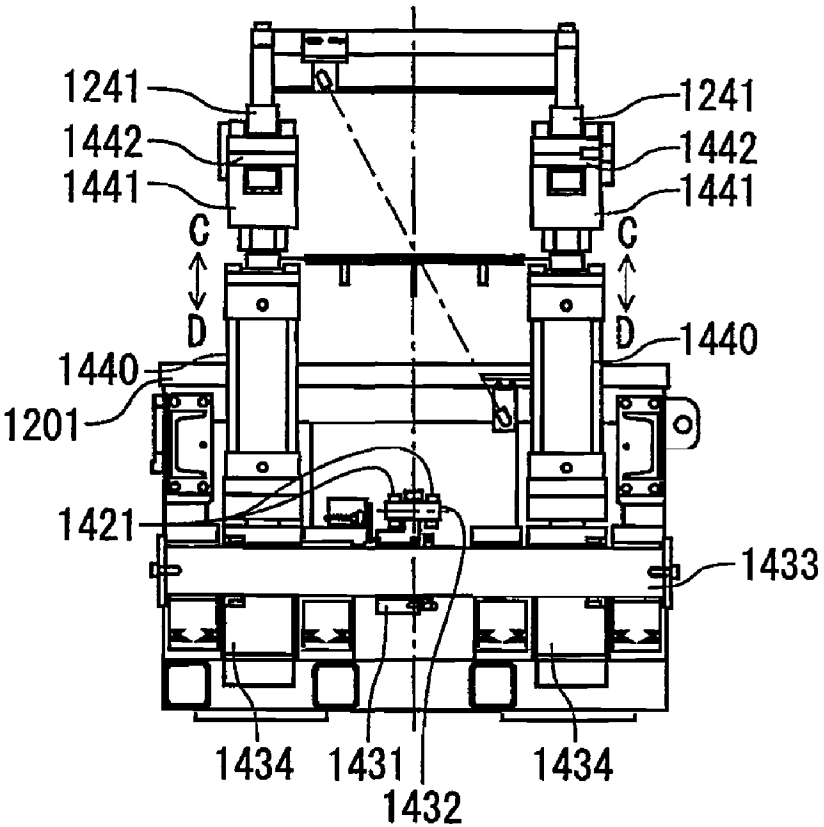
FIG. 8B is a side view showing a portion of the mechanism shown in FIG. 8A as seen from the X direction.

As shown in FIGS. 7, 8A and 8B, the link member 1233 is supported on an upper frame 1241 of the work roll portion 1240 in a swingable manner at a point near one end thereof by means of a pivot shaft 1234, and a portion of the link member 1233 that is near the other end thereof is connected to an output member 1237 of a hydraulic cylinder 1236 by means of a pivot shaft 1235.

In the pinch roll portion 1230, clamping of the work object 2 held between the upper pinch roll 1231 and the lower pinch roll 1232 is achieved by pressing down the output member 1237 of the hydraulic cylinder 1236 downwardly by a predetermined pressing force in order to prevent backward movement of the work object 2 from occurring upon automatic work release or upon power shut down. At least one of the upper pinch roll 1231 and the lower pinch roll 1232 is equipped with a one-way bearing, and the pinch roll portion 1230 in this embodiment has a function of a back stop roll in addition to the above described clamping function.

The work roll portion 1240 has a plurality of upper work rolls 1242 that are provided on an upper frame (which constitutes the front side work roll support member) 1241 and driven by an electric motor 1280 or the like and a plurality of lower work rolls 1244 that are provided on an lower frame (which constitutes the back side work roll support member) 1243 and driven by the electric motor 1280 or the like (not shown). The upper work rolls 1242 and the lower work rolls 1244 are arranged alternately with their rotation centers being offset from each other (in a staggered pattern) along the work object 2 feeding direction as shown in FIG. 7.

On the back side of the upper work rolls 1242 are provided a plurality of upper backup rolls 1242A for supporting the upper work rolls 1242 against reaction force acting thereon to prevent flexure of the upper work rolls 1242. On the back side of the lower work rolls 1244 are provided a plurality of lower backup rolls 1244A for supporting the lower work rolls 1244 against reaction force acting thereon to prevent flexure of the lower work rolls 1244.

In the work roll portion 1240 having the above described structure, the upper work rolls 1242 and the lower work rolls 1244 cooperate to correct (or level) deformation such as winding strain of the work object 2 that is passing between the upper work rolls 1242 and the lower work rolls 1244.

The rotational driving of the upper work rolls 1242 and the lower work rolls 1244 is controlled by the control apparatus 290 in conjunction (or synchronized) with the rotation of the feed roll portion 1250 that will be described later.

The straightener feeder portion 1200 according to this embodiment is provided with an automatic release mechanism 1400, an opening mechanism 1500 and a pressing-down mechanism 1600. Details of these mechanisms will be described later.

In the press portion 300 disposed downstream with respect to the flow of the working process, it is necessary to perform positioning of the work object 2 passed from the straightener feeder portion 1200 before performing press work on it. In connection with this, in order to achieve precise positioning and prevent deformation of the work object 2, it is required upon positioning the work object 2 that the work object 2 be released automatically from the work roll portion 1240 and from the feed roll portion 1250 in the straightener feeder portion 1200 in synchronization with the positioning operation so as to set the work object 2 free in the plane of the work object 2 or with respect to the work object 2 feeding direction. Similarly, in press work that involves deformation of the work object 2, it is required that the work object 2 be released automatically from the work roll portion 1240 and the feed roll portion 1250 in synchronization with the press work. To this end, the automatic release mechanism 1400 is provided.

It is also required that the straightener feeder portion 1200 be capable of performing an opening operation, that is, the operation of opening (separating, or spacing apart) the upper rolls (including the upper pinch roll 1231 and the upper work rolls 1242) and the lower rolls (including the lower pinch roll 1231 and the lower work rolls 1244) to a relatively large extent at the time when the leading edge of the work object 2 is inserted into the pinch roll portion 1230 and the work roll portion 1240 in the straightener feeder portion 1200 upon threading of the work object 2 or at the time when maintenance such as cleaning of the rolls or other portions is to be performed as occasion demands. To this end, the opening mechanism 1500 is provided.

In addition, it is required that the straightener feeder 1200 be capable of adjusting the work object 2 press-down amount by changing the relative position of the upper work rolls 1242 to the lower work rolls 1244 with respect to the vertical direction so that optimal leveling processing can be performed on the work object 2 according to variations in various factors such as the thickness, material and/or the degree of deformation of the work object 2 when correction of deformation (or leveling) of the work object 2 is performed in the work roll portion 1240. To this end, the pressing-down mechanism 1600 is provided.

The work object 2 that has been leveled in a predetermined manner in the straightener feeder portion 1200 is conveyed to the feed roll portion 1250 disposed downstream with respect to the flow of the working process. The feed roll portion 1250 is adapted to be capable of sending out the work object 2 to the press portion 300 at a set feeding speed in synchronization with the press work operation of the press portion 300 that performs press work. The feed roll portion 1250 has an upper feed roll 1252 supported by an upper feed roll support member 1251 and a lower feed roll 1254 supported by a lower frame 1253.

The aforementioned upper feed roll support member 1251 is supported by an upper frame 1255 in such a way as to be slidable with respect to the vertical direction and connected to a ball screw portion 1256 mounted on the upper frame 1255. When the work object 2 is to be sent out, an electric motor 1257 or the like is driven, under control of the control apparatus 290, to move the upper feed roll support member 1251 together with the upper feed roll 1252 downwardly by means of the ball screw portion 1256 so that the work object 2 can be held between the upper feed roll 1252 and the lower feed roll 1254 with a predetermined pressing force.

Upon releasing the work object 2 automatically in synchronization with press work in the press portion 300, the control apparatus 290 is configured to drive the electric motor 1257 or the like to move the upper feed roll support member 1251 and the upper feed roll 1252 by means of the ball screw portion 1256 to thereby release the work object 2.

On the downstream side of the feed roll portion 1250, there may be provided a measuring roll 1260 that measures the actual length of the work object 2 fed by the feed roll portion 1250 to obtain data on an error caused by sliding etc. to be fed back to the positioning process or press work process in the press portion 300.

On the downstream side of the measuring roll 1260, there may be provided a lubricant application apparatus 1270 for applying a lubricant such as a lubricating oil to the work object 2 to prevent galling of the die due to resistance from occurring when press work is performed on the work object 2. The lubricant application apparatus 1270 may be eliminated.

The work object 2 on which lubricant has been applied by the lubricant application apparatus 1270 is fed to the press portion 300 disposed downstream, where press work is performed on the work object 2.

Here, the automatic release mechanism 1400 of the straightener feeder portion 1200 according to this embodiment will be described in detail.

As shown in FIG. 7, the automatic release mechanism 1400 has a servo motor 1410, a ball screw portion 1420, an eccentric cam portion 1430 and a hydraulic cylinder 1440.

As shown in FIGS. 7, 8A and 8B, the ball screw portion 1420 is mounted on the main frame 1201 in a swingable manner by means of a swing shaft 1422. The ball screw portion 1420 is adapted to convert forward and reverse rotation of the servo motor 1410 into back and forth movement of an output member 1421. The output member 1421 is pivotally connected to an arm member 1431 that serves as an input element for the eccentric cam portion 1430 via a connection portion 1432.

The eccentric cam portion 1430 is constructed in such a way that when a shaft 1433 is rotated upon transmission of the input from the arm member 1431 to the shaft 1433, an eccentric cam 1434 mounted on the shaft 1433 is also rotated. Since the eccentric cam 1434 is rotated in a certain eccentric manner with respect to the rotation center of the shaft 1433 as shown in FIGS. 7 and 8B, the rotational movement of the eccentric cam 1434 causes the entire hydraulic cylinder 1440, which is swingably mounted on a circumference (or a peripheral portion) of the eccentric cam 1434 by means of a bearing or the like, to reciprocate in directions indicated by arrows C, D.

As per the above, in this embodiment, the hydraulic cylinder 1440 is moved back and forth as a whole with a lift amount corresponding to the rotational position of the eccentric cam 1434, even when an output member 1441 of the hydraulic cylinder 1440 is not reciprocated.

One end of the output member 1441 of the hydraulic cylinder 1440 is rotatably mounted on the upper frame (corresponding to the front side work roll support member) 1241 of the work roll portion 1240 that belongs to the straightener feeder portion 1200 by means of a connection portion 1442.

The upper frame 1241 is connected to a swing shaft 1245 that is substantially integrally mounted on the main frame 1201, and the upper frame 1241 can swing about the swing shaft 1245 so that its portion near the aforementioned connection portion 1442 can move in the directions indicated by arrows E, F in FIGS. 7 and 8A.

In the following, the automatic release mechanism according to this embodiment will be described.

In this embodiment, when a release signal is sent to the servo motor 1410 in synchronization with press work performed in the press portion 300, the servo motor 1410 is rotated in a predetermined manner. With the rotation of the servo motor 1410, the output member 1421 of the ball screw portion 1420 is moved from the clamping position A to the release position B in FIGS. 7 and 8A. This movement of the output member 1421 in the releasing direction causes the arm member 1431 to rotate in the counterclockwise direction in the drawings by a predetermined amount, and the eccentric cam 1434 substantially integrally mounted on the arm member 1431 is also rotated in the counterclockwise direction in the drawing by a predetermined amount accordingly.

Since the eccentric cam 1434 is mounted in a eccentric manner with respect to the rotation center of the shaft 1433, when the eccentric cam 1434 is rotated in the counterclockwise direction in FIGS. 7 and 8A, the eccentric cam 1434 lifts the entire hydraulic cylinder 1440 in the releasing direction indicated by arrow C in FIGS. 7, 8A and 8B by a lift amount associated with the angular position of the eccentric cam 1434.

Since the output member 1441 of the hydraulic cylinder 1440 is connected to the upper frame 1241 by the connection portion 1442, the upper frame 1241 is swung about the swing shaft 1245 in the releasing direction indicated by arrow E in FIGS. 7 and 8A.

The swinging of the upper frame 1241 in the releasing direction causes the upper work rolls 1242 of the work roll portion 1240 mounted on the upper frame 1241 to move in the releasing direction indicated by arrow E in FIGS. 7 and 8A, whereby the upper work rolls 1242 are spaced apart from the lower rolls by a predetermined distance. Thus, the work object 2 is released. As described before, in synchronization with the releasing operation in the work roll portion 1240, the upper feed roll 1252 of the feed roll portion 1250 is moved by a mechanism different from the automatic release mechanism 1400 in the direction away from the lower feed roll 1254 so as to release the work object 2 automatically. Since the upper pinch roll 1231 in the pinch roll portion 1230 is mounted on the upper frame 1241 in a swingable manner via the link member 1233, it is maintained at its original position in which it can press the work object 2 in an appropriate manner even when the upper frame 1241 is swung in the releasing direction. In this way, backward movement etc. of the work object 2 can be prevented.

When the released state is to be terminated to perform the leveling process on the work object 2 and feed it, the servo motor 1410 is rotated in the direction opposite to the rotation in the release operation by a predetermined amount thereby moving the output member 1421 of the ball screw portion 1420 to the clamping (or unreleasing) position A shown in FIGS. 7 and 8A. With this movement of the output member 1421 to the clamping (or unreleasing) position A, the arm member 1431 is rotated in the clockwise direction in FIGS. 7 and 8A by a predetermined amount, and the eccentric cam 1434 mounted on the arm 1431 is also rotated in the clockwise direction in FIGS. 7 and 8A by a predetermined amount accordingly.

Since the eccentric cam 1434 is mounted in a eccentric manner with respect to the rotation center of the shaft 1433, when the eccentric cam 1434 is rotated in the clockwise direction in the relevant drawings, it causes the entire hydraulic cylinder 1440 to descend in the unreleasing direction indicated by arrow D in FIGS. 7, 8A and 8B by a lift amount associated with the angular position of the eccentric cam 1434.

Since the output member 1441 of the hydraulic cylinder 1440 is connected to the upper frame 1241 by the connection portion 1442, the upper frame 1241 is swung about the swing shaft 1245 in the unreleasing direction indicated by arrow F in FIG. 7.

This causes the upper work rolls 1242 of the work roll portion 1240 mounted on the upper frame 1241 to swing in the unreleasing direction indicated by arrow F in FIGS. 7 and 8A, whereby the work rolls 1242 are returned to a state in which it is in contact with the work object 2 with a predetermined pressure and can perform leveling process on the work object 2. In synchronization with the released state termination operation in the work roll portion 1240, the upper feed roll 1252 in the feed roll portion 1250 is moved toward the lower feed roll 1254 by a mechanism different from the above described automatic release mechanism 1400 so as to be brought into a state in which it can feed the work object 2, as described before.

As described above, in this embodiment, rotational movement of the servo motor 1410 is converted into back and forth movement of the output member 1421 of the ball screw portion 1420, and the release operation is performed by utilizing the back and forth movement. Accordingly, the release operation can be performed with improved response as compared to conventional arrangements in which the release operation is performed using a cylinder, and improvement in working environment can be achieved thanks to a reduction in noise.

In this embodiment, the output member 1421 of the ball screw portion 1420 is connected to the arm member 1431, and the release operation is achieved using the eccentric cam 1434. Thus, by selecting the arm length appropriately and using an efficient operation range of the eccentric cam 1434, the entire hydraulic cylinder 1440 can be moved back and forth with relatively small torque to switch the clamping operation and the release operation. Therefore, the power of the servo motor 1410 may be relatively small, which is advantageous in reducing the size of the apparatus, saving power consumption and reducing the cost. In addition, since the lift amount can be changed easily within the maximum lift amount of the eccentric cam 1434, the degree of freedom in application of the apparatus in terms of the thickness of the work 2 can be increased greatly.

In this embodiment, the ball screw portion 1420 constitutes the first conversion means in the present invention, and the arm member 1431 constitutes the second conversion means in the present invention. Furthermore, the shaft 1433 constitutes the rotary shaft for releasing in the present invention, the eccentric cam 1434 constitutes the eccentric mechanism in the present invention, and the entire hydraulic cylinder 1440 constitutes the reciprocating member in the present invention.

Next, the opening mechanism 1500 according to this embodiment will be described in detail.

As described before, the opening mechanism 1500 is adapted to perform the opening operation in which the upper rolls (including the upper pinch roll 1231 and the upper work rolls 1242) and the lower rolls (including the lower pinch roll 1232 and the lower work rolls 1244) are spaced apart to a relatively large extent upon threading of the work 2 or at the time when maintenance such as cleaning of the rolls or other portions is to be performed. In this embodiment, the opening operation is achieved utilizing back and forth movement of the output member 1441 of the hydraulic cylinder 1440.

Specifically, in the opening operation, when an opening start signal is sent from the control apparatus 290 according to a command entered by an operator or the like, the hydraulic cylinder 1440 extends the output member 1441 in the direction indicated by arrow C in FIGS. 7 and 8A. Since one end of the output member 1441 of the hydraulic cylinder 1440 is rotatably attached, by means of the connection portion 1442, to the upper frame 1241 of the work roll portion 1240 belonging to the straightener feeder portion 1200, the extending motion of the output member 1441 causes the upper frame 1241 to swing about the swing shaft 1245 in the opening direction indicated by arrow E in FIGS. 7 and 8A by a relatively large movement amount.

Since the stroke of the back and forth movement of the output member 1441 of the hydraulic cylinder 1440 is relatively large, the above described swinging of the upper frame 1241 in the opening direction separates the upper rolls (1231, 1242) provided on the upper frame 1241 from the lower rolls (1232, 1244) to a relatively large extent. Thus, a space large enough to allow threading or maintenance work such as cleaning of rolls is formed between the upper rolls (1231, 1242) and the lower rolls (1232, 1244).

After completion of threading or maintenance work such as cleaning of rolls, when an opening termination signal is sent from the control apparatus 290 according to a command entered by the operator or the like, the output member 1441 of the hydraulic cylinder 1440 is retracted in the direction indicated by arrow D in FIGS. 7, 8A and 8B to terminate the opened state. This causes the upper rolls (1231, 1242) provided on the upper frame 1241 to move in the direction indicated by arrow F in the drawings, whereby they come in contact with the work with a predetermined pressing force and are returned to the state in which they can perform leveling processing on the work object 2.

In this embodiment, the hydraulic cylinder 1440 constitutes the reciprocation actuator in the present invention.

Next, the pressing-down mechanism 1600 in the straightener feeder portion 1200 according to this embodiment will be described.

As descried before, the pressing-down mechanism 1600 is a mechanism adapted to adjust the work object 2 press-down amount by changing the position of the upper work rolls 1242 in the vertical direction relative to the lower work rolls 1244 so that optimal leveling processing can be performed on the work 2 according to variations in the thickness of the work 2 fed or other factors when leveling processing is performed on the work object 2 in the work roll portion 1240.

Figure 9:
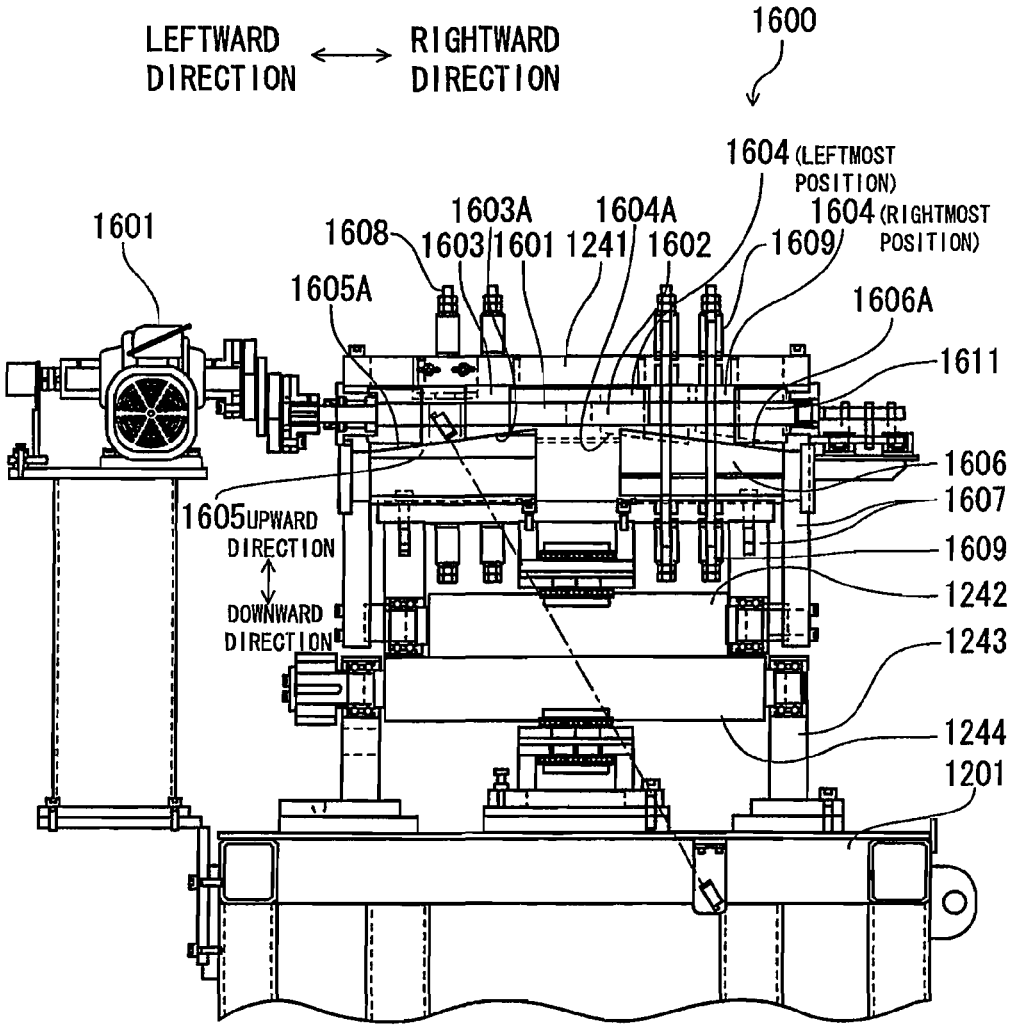
FIG. 9 is an enlarged view illustrating a pressing-down mechanism according to the embodiment of FIG. 6.

As shown in FIG. 9, the pressing-down mechanism 1600 according to this embodiment is composed of trapezoidal screw portions 1601, 1602, an electric motor 1610 that is driven by a control signal sent from the control apparatus 290 according to a press-down amount increase (or decrease) command entered by the operator or the like to supply rotational drive to the trapezoidal screw portions 1601, 1602, upper taper blocks 1603, 1604 that are meshed with the trapezoidal screw portions 1601, 1602 and adapted to be movable toward or away from each other in the leftward and rightward directions in FIG. 9 with rotations of the trapezoidal screw portions 1601, 1602 and lower taper blocks 1605, 1606 having tapered surfaces 1605A, 1606A opposed to and in contact with tapered surfaces 1603A, 1604A of the upper taper blocks 1603, 1604 respectively. On the bottoms of the lower taper blocks 1605, 1606 are supported the upper backup rolls 1242A and the upper work rolls 1242.

As shown in FIG. 9, the lower taper blocks 1605, 1606 are supported by the upper frame 1241 by means of through bolts 1608, and the upper backup rolls 1242A and the upper work rolls 1242 are supported by the lower taper blocks 1605, 1606 via a support member 1607. The mechanism is also provided with springs 1609 through which the trough bolts 1608 are passed. The springs 1609 provide elastic support for the lower taper blocks 1605, 1606 and the support member 1607 etc. on the upper frame 1241.

The trapezoidal screw portion 1601 and the trapezoidal screw portion 1602 are formed on a common shaft 1611 and threaded in directions opposite to each other. Thus, when the shaft 1611 is rotated by the electric motor 1610 in a predetermined direction by a predetermined amount, one upper taper block 1603 screwed to one trapezoidal screw portion 1601 and the other upper taper block 1604 screwed to the other trapezoidal screw portion 1602 are moved on the shaft 1611 in directions toward each other by a predetermined amount, and when the shaft 1611 is rotated in the direction opposite to the aforementioned predetermined direction by a predetermined amount, the upper taper block 1603 and the upper taper block 1604 are moved on the shaft 1611 in directions away from each other by a predetermined amount.

Accordingly, when for example, the upper taper block 1603 (1604) is moved in the rightward (leftward) direction in FIG. 9, a thrust force is exerted on the tapered surface 1605A (1606A) opposed to and in contact with the tapered surface 1603A (1604A) of that upper taper block 1603 (1604) in the rightward (leftward) direction in FIG. 9. By the equilibrium of forces on the tapered surface 1605A (1606A), a force acting in the downward direction in FIG. 9 is exerted on the tapered surface 1605A (1606A) of the lower taper block 1605 (1606), so that the lower taper block 1605 (1606) is moved by a predetermined amount in the downward direction in FIG. 9.

The upper backup rolls 1242A and the upper work rolls 1242 are supported on the lower taper blocks 1605, 1606 via the support member 1607, and when the lower taper blocks 1605, 1606 are moved in the downward direction in FIG. 9 resisting against the bias force of the springs 1609, the upper backup rolls 1242A and the upper work rolls 1242 are also moved in the downward direction in FIG. 9 by a predetermined amount. Thus, the press-down amount of the upper work rolls 1242 against the work object 2 disposed between the upper work rolls 1242 and the lower work rolls 1244 rotatably mounted on the lower frame 1243 can be increased by a predetermined amount.

Conversely, when the upper taper block 1603 (1604) is moved in the leftward (rightward) direction in FIG. 9, the thrust force acting on the tapered surface 1605A (1606A) is weakened, and the upper taper block 1603 (1604) is moved in the upward direction in FIG. 9. With this movement of the upper taper block 1603 (1604), the upper backup rolls 1242A and the upper work rolls 1242 are moved in the upward direction in FIG. 9 by a predetermined amount, whereby the press-down amount of the upper work rolls 1242 against the work object 2 can be decreased by a predetermined amount.

As per the above, according to the pressing-down mechanism 1600 of this embodiment, adjustment of the press-down amount to an appropriate value can be achieved, by a relatively simple structure, according to a requirement or according to variations in, for example, the thickness and/or material of the work object 2, and leveling process can be performed in a desired manner.

Although in the embodiment described in the foregoing use is made of the servo motor 1410, the present invention is not limited to the use of a servo motor, but what is essential is that use is made of at least one electric motor, and other types of motors may also be used so long as they are constructed in such a way that factors such as the speed and the rotation amount can be controlled in forward and reverse rotations (or both rotation directions) and satisfy requirements placed thereon.

The ball screw and the trapezoidal screws used in the ball screw portion 1256, the ball screw portion 1420 and the trapezoidal screw portions 1601, 1602 in the above described embodiment are not intended to limit the present invention, but other mechanisms or structures that can convert rotational movement of an electric motor or the like into output back and forth movement may also be used. For example, a combination of an electric motor and a gear mechanism (e.g. rack and pinion gears) may be used to enable back and forth movement of an output member.

The hydraulic cylinders are not limited to those driven by oil pressure, but other types of reciprocating actuator that can cause an output member to reciprocate utilizing pressure of other kinds of fluid or electromagnetic force may also be used so long as they satisfy requirements placed thereon.

Furthermore, although the above described release mechanism 1400 according to this embodiment releases the work object 2 by utilizing reciprocating motion of the entire hydraulic cylinder 1440 to swing the upper frame (or the front side work roll support member) 1241 relative to the lower frame (or the back side work roll support member) 1243, the present invention is not limited to this particular feature, but any release mechanism that utilizes reciprocating motion of a reciprocating member to move an upper work roll support member to which a portion of the reciprocating member is connected and that supports upper work rolls relative to a lower work roll support member that supports lower work rolls falls within the scope of the present invention.

For example, the structure in which an upper frame 1241 that supports an upper work frame 1242 is configured to be supported by a linear guide or the like in such a way as to be slidable in the vertical direction and the upper frame 1241 is moved relative to a lower frame 1243 that supports lower work rolls 1244 by utilizing back and forth motion of an entire hydraulic cylinder 1440 also falls within the scope of the present invention.

Although embodiments in which the present invention is applied to a leveling apparatus for processing a work to be supplied to a press machine has been described in the foregoing, the present invention is not limited to them. The present invention can also be applied to processing apparatus that performs a certain processing (e.g. plastic working such as forging, rolling or punching) other than press working on a work that has been wound in a coil configuration. The material of the work is not limited to a metal, but it may be other materials such as a resin that requires leveling.

Besides the above, various changes and modifications can be made without departing from the spirit and scope of the present invention.

What is claimed is:

1. A release mechanism for use in a leveling apparatus that performs a leveling process on a work object that is wound in a coil configuration as a result of the work object being passed between at least one front side work roll that is in contact with a front side surface of the work object and at least one back side work roll that is in contact with a back side surface of the work object and has a rotation axis offset with respect to the work feeding direction from a rotation axis of said front side work roll, and said work object being continuously supplied to a press machine after passing said leveling apparatus, the release mechanism comprising:

electric motors arranged side by side along the work feeding direction and configured to be controlled independently from each other;

a plurality of conversion devices provided for each of said electric motors respectively and configured to convert respective rotational movement of the respective electric motors in forward and reverse directions into respective back and forth movement of a plurality of output members corresponding to said respective electric motors; and a control device configured to control switching, in each press work, between a work clamp state that allows performance of said leveling process and a release state that releases the work from said clamp state by displacing at least one of a front side work roll support member that supports said front side work roll and a back side work roll support member that supports said back side work roll relative to the other to change a distance between said front side work roll and said back side work roll, by utilizing the respective back and forth movement of the respective output members output respectively by said plurality of conversion devices, wherein the control device controls the switching while the work object is continuously supplied to the press machine, passing through the leveling apparatus, and wherein at least one of said front side work roll support member and said back side work roll support member is connected to the respective output members.

2. A release mechanism according to claim 1, wherein said electric motors comprise servo motors.

3. The release mechanism according to claim 1, wherein the plurality of conversion devices comprise ball screw mechanisms.

4. A leveling apparatus that performs a leveling process on a work object by causing the work object to pass between at least one front side work roll that is in contact with a front side surface of the work object and at least one back side work roll that is in contact with a back side surface of the work object and has a rotation axis offset with respect to the work feeding direction from a rotation axis of said front side work roll, the leveling apparatus comprising:

a release mechanism including:

electric motors arranged side by side along the work feeding direction and configured to be controlled independently from each other;

a plurality of conversion devices provided for each of said electric motors respectively and configured to convert respective rotational movement of the respective electric motors in forward and reverse directions into respective back and forth movement of a plurality of output members corresponding to said respective electric motors; and a control device configured to control switching, in each press work, between a work clamp state that allows performance of said leveling process and a release state that releases the work from said clamp state by displacing at least one of a front side work roll support member that supports said front side work roll and a back side work roll support member that supports said back side work roll relative to the other to change a distance between said front side work roll and said back side work roll, by utilizing the respective back and forth movement of the respective output members output respectively by said plurality of conversion devices, wherein the control device controls the switching while the work object is continuously supplied to the press machine, passing through the leveling apparatus, and wherein at least one of said front side work roll support member and said back side work roll support member is connected to the respective output members.

5. The leveling apparatus according to claim 4, wherein said release mechanism is configured to function as an opening mechanism of displacing at least one of said front side work roll support member and said back side work roll support member relative to the other to separate said front side work roll and said back side work roll, by utilizing the respective back and forth movement of the respective output members output respectively by said plurality of conversion devices, at least when said leveling process is suspended, and wherein at least one of said front side work roll support member and said back side work roll support member is connected to the respective output members.

6. The leveling apparatus according to claim 4, wherein said release mechanism is configured to function as a pressing-down mechanism of displacing at least one of said front side work roll support member and said back side work roll support member relative to the other to enable adjustment of pressing-down amount of said upper work roll against the work, via utilizing the respective back and forth movement of the respective output members output respectively by said plurality of conversion devices, and wherein at least one of said front side work roll support member and said back side work roll support member is connected to the respective output members.

7. The leveling apparatus according to claim 4, further comprising:

a lower taper block on which said front side work roll is supported, said lower taper block having a tapered surface on its top surface;

an upper taper block having a tapered surface on its bottom surface, said tapered surface of said upper taper block being opposed to said tapered surface of said lower taper block;

a shaft-like screw member screwed to said upper taper block; and a pressing-down mechanism configured to adjust a pressing down amount of said upper work roll against the work by rotating said screw member by another electric motor to cause said upper taper block to move back and forth along said screw member thereby adjusting the relative position of the tapered surface on the bottom surface of said upper taper block and the tapered surface on the top surface of said lower taper block opposed to the tapered surface on the bottom surface of said upper taper block.

8. A leveling apparatus for performing a leveling process on a work object that is wound in a coil configuration as a result of the work object being passed between at least one front side work roll that is in contact with a front side surface of the work object and at least one back side work roll that is in contact with a back side surface of the work object and has a rotation axis offset with respect to the work feeding direction from a rotation axis of said front side work roll, and said work object being continuously supplied to a press machine after passing said leveling apparatus, the leveling apparatus comprising:

a press-down mechanism comprising:

a lower taper block on which said front side work roll is supported, said lower taper block having a tapered surface on its top surface;

an upper taper block having a tapered surface on its bottom surface, said tapered surface of said upper taper block being opposed to said tapered surface of said lower taper block; and a shaft-like screw member screwed to said upper taper block, wherein said pressing-down mechanism is configured to adjust a pressing down amount of said upper work roll against the work by rotating said screw member by an electric motor to cause said upper taper block to move back and forth along said screw member thereby adjusting the relative position of the tapered surface on the bottom surface of said upper taper block and the tapered surface on the top surface of said lower taper block opposed to the tapered surface on the bottom surface of said upper taper block, and a releasing mechanism comprising:

another electric motor provided independently from said electric motor; and a control device configured to control switching, in each press work, between a work clamp state that allows performance of said leveling process and a release state that releases the work from said clamp state by displacing at least one of a front side work roll support member that supports said front side work roll and a back side work roll support member that supports said back side work roll relative to the other to change a distance between said front side work roll and said back side work roll, by utilizing rotational movement of said another electric motor in forward and reverse directions, wherein the control device controls the switching while the work object is continuously supplied to the press machine, passing through the leveling apparatus.

9. The leveling apparatus according to claim 8, wherein said another electric motor comprises a servo motor.

10. The leveling apparatus according to claim 8, the releasing mechanism further comprising:

a conversion device having an output member and a ball screw mechanism, configured to convert the rotational movement of the another electric motor in forward and reverse directions into back and forth movement of the output member, wherein the control device of said releasing mechanism controls the switching between the work clamp state and the release state by displacing at least one of the front side work roll support member and the back side work roll support member relative to the other to change a distance between the front side work roll and the back side work roll, by utilizing the back and forth movement of the output member of the conversion device.

* * * * *